US007282103B2

(12) United States Patent
Sakamoto et al.

(10) Patent No.: US 7,282,103 B2
(45) **Date of Patent: *Oct. 16, 2007**

(54) IRON-BASE AMORPHOUS ALLOY THIN STRIP EXCELLENT IN SOFT MAGNETIC PROPERTIES, IRON CORE MANUFACTURED BY USING SAID THIN STRIP, AND MOTHER ALLOY FOR PRODUCING RAPIDLY COOLED AND SOLIDIFIED THIN STRIP

(75) Inventors: Hiroaki Sakamoto, Futtsu (JP); Yuichi Sato, Futtsu (JP)

(73) Assignee: Nippon Steel Corporation, Tokyo (JP)

( * ) Notice: Subject to any disclaimer, the term of this patent is extended or adjusted under 35 U.S.C. 154(b) by 534 days.

This patent is subject to a terminal disclaimer.

(21) Appl. No.: 10/479,765

(22) PCT Filed: Mar. 31, 2003

(86) PCT No.: PCT/JP03/04089

§ 371 (c)(1),
(2), (4) Date: Dec. 4, 2003

(87) PCT Pub. No.: WO03/085150

PCT Pub. Date: Oct. 16, 2003

(65) Prior Publication Data

US 2004/0140016 A1 Jul. 22, 2004

(30) Foreign Application Priority Data

| | | |
|---|---|---|
| Apr. 5, 2002 | (JP) | 2002-104260 |
| Apr. 5, 2002 | (JP) | 2002-104261 |
| Apr. 5, 2002 | (JP) | 2002-104262 |
| Apr. 5, 2002 | (JP) | 2002-104263 |
| Apr. 10, 2002 | (JP) | 2002-108134 |
| Apr. 15, 2002 | (JP) | 2002-111940 |
| Apr. 17, 2002 | (JP) | 2002-114818 |
| Apr. 17, 2002 | (JP) | 2002-114819 |
| Apr. 17, 2002 | (JP) | 2002-114820 |

(51) Int. Cl.
*H01F 1/153* (2006.01)

(52) U.S. Cl. ..... 148/305; 148/304; 148/403

(58) Field of Classification Search ..... None
See application file for complete search history.

(56) References Cited

U.S. PATENT DOCUMENTS 4,504,327 A 3/1985 Inomata et al.

(Continued)

FOREIGN PATENT DOCUMENTS

JP A-57-185957 11/1982

(Continued)

OTHER PUBLICATIONS

Machine Translation of Japanese Patent Document No. 2000-309860.*

(Continued)

*Primary Examiner*—John P. Sheehan
(74) *Attorney, Agent, or Firm*—Kenyon & Kenyon LLP

(57) ABSTRACT

The present invention provides an iron-base amorphous alloy thin strip excellent in soft magnetic properties, an iron core manufactured by using said thin strip, and a mother alloy for producing a rapidly cooled and solidified thin strip. More specifically, the present invention is an iron-base amorphous alloy thin strip produced by rapidly cooling and solidifying molten metal by ejecting it onto a moving cooling substrate through a pouring nozzle having a slot-shaped opening, characterized by having an ultra-thin oxide layer of a thickness in the range from 5 to 20 nm on one or both of the surfaces of the amorphous mother phase containing P in the range from 0.2 to 12 atomic %.

6 Claims, 1 Drawing Sheet

U.S. PATENT DOCUMENTS

| | | | | | |
|---|---|---|---|---|---|
| 4,588,452 | A | * | 5/1986 | Nathasingh et al. | 148/108 |
| 4,889,568 | A | * | 12/1989 | Datta et al. | 148/108 |
| 5,474,624 | A | * | 12/1995 | Suzuki et al. | 148/121 |
| 6,053,989 | A | * | 4/2000 | Orillion et al. | 148/304 |
| 6,416,879 | B1 | | 7/2002 | Sakamoto et al. | |
| 2003/0205295 | A1 | * | 11/2003 | Yoshida et al. | 148/108 |

FOREIGN PATENT DOCUMENTS

| | | | |
|---|---|---|---|
| JP | A-63-45318 | | 2/1988 |
| JP | 4-329846 | A | 11/1992 |
| JP | A-8-193252 | | 7/1996 |
| JP | A-9-202946 | | 8/1997 |
| JP | A-9-202951 | | 8/1997 |
| JP | A-9-268354 | | 10/1997 |
| JP | A-11-293427 | | 10/1999 |
| JP | A-11-300450 | | 11/1999 |
| JP | 2000-54089 | A | 2/2000 |
| JP | 2000-313946 | A | 11/2000 |
| JP | A-2000-309860 | | 11/2000 |
| JP | A-2000-313946 | | 11/2000 |
| JP | A-2002-220646 | | 8/2002 |

OTHER PUBLICATIONS

Morito, Nobuyuki et al. "Degradation of a Small Amount of Ti on the Magnetic Properties of Fe-B-Si Amorphous Alloy" J. Japan Inst. Metals, vol. 52, No. 7 (1988), pp. 733-741.

IEEE Transactions on Magnetics, vol. MAG-11, No. 6, Nov. 1975, pp. 1644-1649.

* cited by examiner

IRON-BASE AMORPHOUS ALLOY THIN STRIP EXCELLENT IN SOFT MAGNETIC PROPERTIES, IRON CORE MANUFACTURED BY USING SAID THIN STRIP, AND MOTHER ALLOY FOR PRODUCING RAPIDLY COOLED AND SOLIDIFIED THIN STRIP

TECHNICAL FIELD

The present invention relates to: an iron-base amorphous alloy thin strip excellent in soft magnetic properties used as a material for the iron core of a power transformer, a high frequency transformer or the like; an iron core manufactured by using said thin strip; and a mother alloy for producing a rapidly cooled and solidified thin strip used for the iron-base amorphous alloy thin strip and the iron core.

BACKGROUND ART

An amorphous alloy thin strip is produced by rapidly cooling an alloy in a molten state. Processes such as the centrifugal rapid cooling process, the single-roll process, the twin-roll process and the like are known as the methods for producing thin strips. In such a process, a thin strip or a thin wire is produced by ejecting molten metal through an orifice or the like onto the inner or outer surface of a rapidly rotating metal drum and thus rapidly solidifying the molten metal. An amorphous alloy excellent in magnetic, mechanical and/or corrosion properties is obtained by suitably selecting the alloy composition thereof.

Such an amorphous alloy thin strip is viewed as a promising industrial material for various applications due to the excellent properties thereof. As a material for the iron core of a power transformer, a high frequency transformer or the like, in particular, an iron-base amorphous alloy thin strip, for example that of an Fe—Si—B system, is used for the reason that it has a low core loss, a high saturation magnetic flux density, a high magnetic permeability, etc.

An iron-base amorphous alloy thin strip that has electrically insulating films of oxide or the like formed on the surfaces, for the purpose of improving the magnetic properties when it is used as a material for an iron core, is known. In an iron core for a transformer formed by winding a thin strip or laminating thin strip sheets, the insulating coating films have the effects of improving electrical insulation between the layers of the iron core and reducing the eddy current loss caused by crossover magnetic flux.

The present inventors have disclosed in Japanese Unexamined Patent Publication No. H11-300450 an iron-base amorphous alloy thin strip produced by rapid cooling and solidification and having an ultra-thin oxide layer of an adequate thickness at least on one of the surfaces, and another thin strip having a segregation layer containing P and/or S in the lower portion of an oxide layer similar to the above.

The present inventors have also disclosed in Japanese Unexamined Patent Publication No. 2000-309860 an iron-base amorphous alloy thin strip having a segregation layer containing one or more of As, Sb, Bi, Se and Te in the vicinity of the interface between an ultra-thin oxide layer and the amorphous mother phase. In addition, they have disclosed in Japanese Unexamined Patent Publication No. 2000-313946 an iron-base amorphous alloy thin strip having an ultra-thin oxide layer of a bilaminar structure, and another similar thin strip having one or more of P, As, Sb, Bi, S, Se and Te segregating in the second lamina of the oxide layer on the side of the mother phase.

When a wound iron core transformer or a laminated iron core transformer is fabricated with such an amorphous alloy thin strip as mentioned above, usually, the thin strip is wound toroidally to form a wound iron core or many sheets of the thin strip are piled to form a laminated iron core, and thereafter the iron core undergoes annealing while a direct current magnetic field is imposed in the direction of a magnetic circuit. The purpose of annealing is to improve a magnetic flux density by creating magnetic anisotropy in the direction of the imposed magnetic field and to lower a core loss by reducing strain existing in the thin strip.

When an annealing temperature is low in the above treatment, magnetic anisotropy is hardly created and therefore a magnetic flux density does not improve; what is worse, strain is not removed and therefore a core loss is not lowered either. However, when an annealing temperature is low, the embrittlement of a thin strip resulting from annealing is mitigated.

On the other hand, when an annealing temperature is high, a magnetic flux density is improved and, at the same time, strain is removed sufficiently and therefore a core loss is reduced, but the embrittlement of a thin strip becomes significant. The cause of the embrittlement of a thin strip resulting from annealing has not been clarified yet, but it is estimated that the embrittlement is caused by the fact that atoms, which have been arranged comparatively randomly, are locally rearranged into orderly structures during rapid cooling and solidification. When an annealing temperature is still higher, a thin strip crystallizes and the excellent soft magnetic properties peculiar to an amorphous material are not retained any longer.

Therefore, there is a certain optimum temperature in the annealing of an iron core. In such an annealing treatment, however, as the weight and the volume of an iron core increase, temperature unevenness is more likely to occur at different portions of the iron core during heating after it is charged into a heat treatment furnace. The temperature unevenness can be reduced by taking sufficient time during heating and cooling, but this lowers productivity.

As measures for improving such an annealing process, various methods have been proposed so far: for example, Japanese Unexamined Patent Publication No. S63-45318 discloses a method wherein a heat insulating material is attached around the inner and outer circumferences of an iron core and thus temperature differences in the iron core during cooling are minimized. Ideally, it is desirable to improve a thin strip itself so that temperature unevenness may not cause an adverse effect even when it occurs. However, there has not so far been any iron-base amorphous alloy thin strip that can reduce the performance deterioration caused by temperature unevenness at different portions of an iron core in an annealing process.

In view of the above situation, the present inventors have invented an iron-base amorphous alloy thin strip capable of securing excellent soft magnetic properties and suppressing the embrittlement of the thin strip even when temperature unevenness occurs at different portions of the iron core during annealing or a lower annealing temperature is applied, by adding P, to an amount in a specified range, to an alloy having a composition in the range wherein the amounts of Fe, Si, B and C are regulated, and have applied the invention as Japanese Patent Application No. 2001-123359 (hereinafter referred to as "the prior invention").

Each of the iron-base amorphous alloy thin strips disclosed in the aforementioned patent publications contains the following elements as a part of each desirable chemical composition: P and/or S in the range from 0.0003 to 0.1 mass % in the case of Japanese Unexamined Patent Publication No. H11-300450; one or more of As, Sb, Bi, Se and Te in the range from 0.0003 to 0.15 mass % in the case of Japanese Unexamined Patent Publication No. 2000-309860; and one or more of P, As, Sb, Bi, S, Se and Te in the range from 0.0003 to 0.15 mass % in the case of Japanese Unexamined Patent Publication No. 2000-313946.

As stated in the description of the aforementioned prior invention, iron-base amorphous alloy thin strips containing P have been disclosed in Japanese Unexamined Patent Publication Nos. S57-185957, H8-193252, H9-202946, H9-202951, H9-268354 and H11-293427. However, each of the patent publications is different from the prior invention in chemical composition, and does not reduce the performance deterioration caused by temperature unevenness.

Meanwhile, when such an iron-base amorphous alloy thin strip is cast, high purity iron such as electrolytic iron has been used as iron source for the reason that a low core loss is not secured if impurity elements are contained therein, and other reasons. In relation to this, the present inventors have disclosed in Japanese Unexamined Patent Publication No. H9-202946 an Fe—Si—B—C system amorphous alloy thin strip having a specific chemical composition and containing, in mass, $0.008\% \leqq P \leqq 0.1\%$, $0.15\% \leqq Mn \leqq 0.5\%$, and $0.004\% \leqq S \leqq 0.05\%$ as impurity elements. In such a thin strip, not only a core loss is improved but also the permissible amounts of Mn and S as impurity elements are increased by containing a small amount of P as stated above (0.1 mass % P corresponds to 0.16 atomic % P, approximately), and, as a result, an inexpensive steel produced through ordinary steelmaking processes can be used as an iron source.

A steel produced through ordinary steelmaking processes contains, as impurity elements, besides Mn and S mentioned above, various elements originating from deoxidizing agents, refractory materials, different grades of steel sticking to steelmaking vessels, and so on. Among those elements, the elements easily combining with O, N or C and forming precipitates, such as Al, Ti and Zr, accelerate the crystallization of an amorphous alloy thin strip during casting, and, for this reason, a steel containing the possible least amounts of these elements has so far been used.

With regard to Al and Ti, it is described that a very small addition amount of either Al or Ti causes the crystallization in the surface layers of a thin strip and the deterioration of a core loss in the Proceedings of the 4th International Conference on Rapidly Quenched Metals, 957 (1981) regarding Al and in the Journal of the Japan Institute of Metals, Vol. 52, No. 7, 733 (1988) regarding Ti.

Further, Japanese Unexamined Patent Publication No. H4-329846 discloses that the deterioration of product properties can be inhibited by adding 0.1 to 1.0 mass % Sn and/or 0.01 to 0.05 mass % S in the event of using a low purity raw material containing one or more of Al, Ti and Zr by 0.01 mass % or more. However, the patent publication also discloses that the addition of Sn and/or S causes the deterioration of embrittlement. Further, as seen in Example of the patent publication, even with the addition of Sn, a core loss is still at a poor level of 0.15 W/kg or more in $W_{13/50}$.

DISCLOSURE OF THE INVENTION

In view of the above situation, an object of the present invention is to provide an iron-base amorphous alloy thin strip to be used as a material for the iron core of a power transformer, a high frequency transformer or the like, the amorphous alloy thin strip being excellent in overall soft magnetic properties not only in the amorphous mother phase, which properties are improved, of the thin strip but also in an ultra-thin oxide layer formed on each of the surfaces of the thin strip and a segregation layer formed between the ultra-thin oxide layer and the amorphous mother phase, by actively adding P, which has hitherto been viewed as undesirable, and adequately controlling the addition amount of P.

Another object of the present invention is to clearly define the lower limit of an Si content and expand the range of a chemical composition in the production of an iron-base amorphous alloy thin strip so that the embrittlement of the thin strip may be suppressed and excellent soft magnetic properties may be secured even when temperature unevenness occurs at different portions of an iron core or a lower annealing temperature is applied during the annealing of the iron core after it is formed by laminating sheets of the thin strip, by adding P of an amount in a specified range.

Still another object of the present invention is to make it possible to use a general-purpose steel produced through ordinary steelmaking processes as iron source in the production of an iron-base amorphous alloy thin strip by significantly suppressing the crystallization of the thin strip even if Al, Ti, etc., which have been considered to accelerate crystallization during the casting of a thin strip, are contained therein, and thus preventing the deterioration of a core loss and other properties.

The gist of the present invention, which has been established for solving the above problems, is as follows:

(1) An iron-base amorphous alloy thin strip produced by rapidly cooling and solidifying molten metal by ejecting it onto a moving cooling substratum through a pouring nozzle having a slot-shaped opening, characterized by having an ultra-thin oxide layer of a thickness in the range from 5 to 20 nm on one or both of the surfaces of the amorphous mother phase containing P in the range from 0.2 to 12 atomic %.

(2) An iron-base amorphous alloy thin strip according to the item (1), characterized by having a segregation layer containing P and/or S between said ultra-thin oxide layer and said amorphous mother phase.

(3) An iron-base amorphous alloy thin strip according to the item (1), characterized in that said ultra-thin oxide layer has a bilaminar structure.

(4) An iron-base amorphous alloy thin strip according to any one of the items (1) to (3), characterized by having an ultra-thin oxide layer on the surface of said thin strip at least on the side not touching the cooling substratum.

(5) An iron-base amorphous alloy thin strip according to the item (2) or (4), characterized in that the thickness of said segregation layer is 0.2 nm or more.

(6) An iron-base amorphous alloy thin strip according to the item (3) or (4), characterized in that both the laminas of said bilaminar ultra-thin oxide layer are amorphous oxide laminas.

(7) An iron-base amorphous alloy thin strip according to the item (3) or (4), characterized in that, in said bilaminar ultra-thin oxide layer: the first oxide lamina at the outermost surface of the thin strip is a mixed lamina consisting of crystalline and amorphous oxides; and the second oxide lamina between said first oxide lamina and the amorphous mother phase is an amorphous oxide lamina.

(8) An iron-base amorphous alloy thin strip according to the item (3) or (4), characterized in that, in said bilaminar ultra-thin oxide layer: the first oxide lamina at the outermost surface of the thin strip is a crystalline oxide lamina; and the second oxide lamina between said first oxide lamina and the amorphous mother phase is an amorphous oxide lamina.

(9) An iron-base amorphous alloy thin strip according to any one of the items (1) to (8), characterized in that said ultra-thin oxide layer consists of Fe oxide, Si oxide, B oxide or a composite of these oxides.

(10) An iron-base amorphous alloy thin strip according to any one of the items (7) to (9), characterized in that the crystalline oxide composing a part of said ultra-thin oxide layer is Fe oxide having a spinel structure.

(11) An iron-base amorphous alloy thin strip according to any one of the items (3), (4) and (6) to (10), characterized in that the total thickness of said bilaminar ultra-thin oxide layer is in the range from 5 to 20 nm, the thickness of said first oxide lamina is in the range from 3 to 15 nm, and that of said second oxide lamina is in the range from 2 to 10 nm.

(12) An iron-base amorphous alloy thin strip according to any one of the items (3), (4) and (6) to (10), characterized in that at least one or more elements of P, As, Sb, Bi, S, Se and Te segregate in said second oxide lamina.

(13) An iron-base amorphous alloy thin strip according to any one of the items (1) to (12), characterized in that the thickness of said thin strip is in the range from 10 to 100 μm.

(14) An iron-base amorphous alloy thin strip excellent in alternating current soft magnetic properties, the amorphous alloy thin strip consisting of the main elements of Fe, Co, Si, B, C and P and unavoidable impurities, characterized in that the contents of said main elements are, in atomic percentage, in the ranges from 78 to 86% as to $Fe_{1-X}Co_X$ (wherein $0.05 \leqq X \leqq 0.4$), from 2 to less than 4% as to Si, from more than 5 to 16% as to B, from 0.02 to 4% as to C, and from 0.2 to 12% as to P.

(15) An iron-base amorphous alloy thin strip excellent in alternating current soft magnetic properties according to the item (14), characterized in that the content of $Fe_{1-X}Co_X$ (wherein $0.05 \leqq X \leqq 0.4$) is in the range from more than 80 to 82 atomic %.

(16) An iron-base amorphous alloy thin strip excellent in alternating current soft magnetic properties according to the item (14) or (15), characterized by having: such soft magnetic properties that the values of $B_{80}$ after annealing are 1.37 T or more and the standard deviation of the values of $B_{80}$ is less than 0.1; and such an annealing temperature characteristic that the value of $\Delta T_A$ defined as $\Delta T_A = T_A max - T_A min$ is at least 80° C., wherein $T_A max$ and $T_A min$ represent respectively the maximum and minimum annealing temperatures between which said soft magnetic properties are secured.

(17) An iron-base amorphous alloy thin strip excellent in alternating current soft magnetic properties, the amorphous alloy thin strip consisting of the main elements of Fe, Ni, Si, B, C and P and unavoidable impurities, characterized in that the contents of said main elements are, in atomic percentage, in the ranges from 78 to 86% as to $Fe_{1-Y}Ni_Y$ (wherein $0.05 \leqq Y \leqq 0.2$), from 2 to less than 4% as to Si, from more than 5 to 16% as to B, from 0.02 to 4% as to C, and from 0.2 to 12% as to P.

(18) An iron-base amorphous alloy thin strip according to the item (17), characterized in that the content of $Fe_{1-Y}Ni_Y$ (wherein $0.05 \leqq Y \leqq 0.2$) is in the range from more than 80 to 82 atomic %.

(19) An iron-base amorphous alloy thin strip excellent in alternating current soft magnetic properties according to the item (17) or (18), characterized by having: such soft magnetic properties that the values of $B_{80}$ after annealing are 1.35 T or more and the standard deviation of the values of $B_{80}$ is less than 0.1; such an annealing temperature characteristic that the value of $\Delta T_A$ defined as $\Delta T_A = T_A max - T_A min$ is at least 80° C., wherein $T_A max$ and $T_A min$ represent respectively the maximum and minimum annealing temperatures between which said soft magnetic properties are secured; and such an excellent embrittlement resistance that the fracture strain of the thin strip $\epsilon_f$ defined as $\epsilon_f = t/(D_f - t)$ is 0.015 or more, wherein t represents the thickness of an annealed thin strip subjected to 180° bend test and $D_f$ the diameter of the bend at the time when the thin strip fractures.

(20) An iron-base amorphous alloy thin strip excellent in alternating current soft magnetic properties, the amorphous alloy thin strip being produced by rapidly cooling and solidifying a molten alloy by ejecting it onto a moving cooling substrate through a pouring nozzle having a slot-shaped opening and consisting of the main elements of Fe, Si, B, C and P and unavoidable impurities, characterized in that: the contents of said main elements are, in atomic percentage, in the ranges from 78 to 86% as to Fe, from 2 to less than 4% as to Si, from 2 to 15% as to B, from 0.02 to 4% as to C, and from 1 to 14% as to P, while the content of B+P is maintained in the range from 12 to 20%; and the value of (Wmax−Wmin)/Wmin is 0.4 or less, wherein Wmax and Wmin represent respectively the maximum and minimum values of core loss after annealing at different positions across the width of the thin strip.

(21) An iron-base amorphous alloy thin strip excellent in alternating current soft magnetic properties, the amorphous alloy thin strip being produced by rapidly cooling and solidifying molten alloy by ejecting it onto a moving cooling substrate through a pouring nozzle having a slot-shaped opening and consisting of the main elements of Fe, Si, B, C and P and unavoidable impurities, characterized in that: the contents of said main elements are, in atomic percentage, in the ranges from 78 to 86% as to Fe, from 2 to less than 4% as to Si, from 2 to 15% as to B, from 0.02 to 4% as to C, and from 1 to 14% as to P, while the content of B+P is maintained in the range from 12 to 20%; and said thin strip has such a good shape characteristic that the region where the number of the coarse air pockets 500 μm or more in length or 50 μm or more in width in $10/cm^2$ or less is 80% or more in area percentage, the coarse air pockets inevitably forming at the surface of the thin strip on the side touching the cooling substratum.

(22) An iron-base amorphous alloy thin strip excellent in alternating current soft magnetic properties, the amorphous alloy thin strip being produced by rapidly cooling and solidifying molten alloy by ejecting it onto a moving cooling substrate through a pouring nozzle having a slot-shaped opening and consisting of the main elements of Fe, Si, B, C and P and unavoidable impurities, characterized in that: the contents of said main elements are, in atomic percentage, in the ranges from 78 to 86% as to Fe, from 2 to less than 4% as to Si, from 2 to 15% as to B, from 0.02 to 4% as to C, and from 1 to 14% as to P, while the content of B+P is maintained in the range from 12 to 20%; and said thin strip has such a good shape characteristic that the value of Δtdefined as Δt=tmax−tmin is 5 μm or less, wherein tmax and tmin represent respectively the maximum and minimum thicknesses of the thin strip at arbitrary positions across the width of the thin strip.

(23) An iron-base amorphous alloy thin strip excellent in alternating current soft magnetic properties according to the item (22), characterized in that the value of said Δtis 3 μm or less.

(24) An iron-base amorphous alloy thin strip excellent in alternating current soft magnetic properties, the amorphous alloy thin strip consisting of the main elements of Fe, B, C and P and unavoidable impurities, characterized in that the contents of said main elements are, in atomic percentage, in the ranges from 78 to 86% as to Fe, from more than 5 to 16% as to B, from 0.02 to 8% as to C, and from 0.2 to 12% as to P.

(25) An iron-base amorphous alloy thin strip excellent in alternating current soft magnetic properties, the amorphous alloy thin strip consisting of the main elements of Fe, Si, B, C and P and unavoidable impurities, characterized in that the contents of said main elements are, in atomic percentage, in the ranges from 78 to 86% as to Fe, from 0.02 to less than 2% as to Si, from more than 5 to 16% as to B, from 0.02 to 8% as to C, and from 0.2 to 12% as to P.

(26) An iron-base amorphous alloy thin strip excellent in alternating current soft magnetic properties according to any one of the items (14) to (25), characterized in that the content of P is in the range from 1 to 12 atomic %.

(27) An iron-base amorphous alloy thin strip excellent in alternating current soft magnetic properties, the amorphous alloy thin strip consisting of the main elements of Fe, Si, B, C and M and unavoidable impurities, wherein M indicates one or more of As, Bi, S, Se and Te, characterized in that the contents of said main elements are, in atomic percentage, in the ranges from 78 to 86% as to Fe, from 2 to less than 4% as to Si, from more than 5 to 16% as to B, from 0.02 to 4% as to C, and from 0.2 to 12% as to M.

(28) An iron-base amorphous alloy thin strip excellent in alternating current soft magnetic properties, the amorphous alloy thin strip consisting of the main elements of Fe, Si, B, C and P+M and unavoidable impurities, wherein M indicates one or more of As, Bi, S, Se and Te, characterized in that the contents of said main elements are, in atomic percentage, in the ranges from 78 to 86% as to Fe, from 2 to less than 4% as to Si, from more than 5 to 16% as to B, from 0.02 to 4% as to C, and from 0.2 to 12% as to P+M.

(29) An iron-base amorphous alloy thin strip excellent in alternating current soft magnetic properties according to the item (27), characterized in that the content of said M is in the range from 1 to 12 atomic %.

(30) An iron-base amorphous alloy thin strip excellent in alternating current soft magnetic properties according to the item (28), characterized in that the content of said P+M is in the range from 1 to 12 atomic %.

(31) An iron-base amorphous alloy thin strip excellent in alternating current soft magnetic properties according to any one of the items (24), (25) and (27) to (30), characterized by having: such soft magnetic properties that the values of $B_{80}$ after annealing are 1.35 T or more and the standard deviation of the values of $B_{80}$ is less than 0.1; and such an annealing temperature characteristic that the value $\Delta T_A$ defined as $\Delta T_A = T_A max - T_A min$ is at least 80° C., wherein $T_A max$ and $T_A min$ represent respectively the maximum and minimum annealing temperatures between which said soft magnetic properties are secured.

(32) An iron-base amorphous alloy thin strip excellent in alternating current soft magnetic properties according to any one of the items (14) to (19), (24), (25) and (27) to (30), characterized by having: such a core loss characteristic that the core loss after annealing is 0.12 W/kg or less; and such an annealing temperature characteristic that the value of $\Delta T_B$ defined as $\Delta T_B = T_B max - T_B min$ is at least 60° C., wherein $T_B max$ and $T_B min$ represent respectively the maximum and minimum annealing temperatures between which said core loss characteristic is secured.

(33) An iron-base amorphous alloy thin strip excellent in alternating current soft magnetic properties according to any one of the items (20) to (23), characterized by having such a core loss characteristic that the core loss after annealing is 0.12 W/kg or less.

(34) An iron-base amorphous alloy thin strip excellent in alternating current soft magnetic properties according to any one of the items (14) to (16), (24), (25) and (27) to (30), characterized by having such an excellent embrittlement resistance that the fracture strain of the thin strip $\epsilon_f$ defined as $\epsilon_f = t/(D_f - t)$ is 0.01 or more, wherein t represents the thickness of an annealed thin strip subjected to 180° bend test and $D_f$ the diameter of the bend at the time when the thin strip fractures.

(35) An iron-base amorphous alloy thin strip excellent in alternating current soft magnetic properties according to any one of the items (14) to (34), characterized in that the content of B is in the range from more than 5 to less than 14 atomic %.

(36) An iron-base amorphous alloy thin strip excellent in alternating current soft magnetic properties according to any one of the items (20) to (35), characterized in that the content of Fe is in the range from more than 80 to 82 atomic %.

(37) An iron-base amorphous alloy thin strip characterized in that: the composition of said thin strip consists of the main elements of Fe, B, C and one or more of P, As, Bi, S, Se and Te, and impurity elements containing the elements that form precipitates combining with O, N or C; and the total content of the precipitate forming elements is 2.5 mass % or less.

(38) An iron-base amorphous alloy thin strip characterized in that: the composition of said thin strip consists of the main elements of Fe, Si, B, C and one or more of P, As, Bi, S, Se and Te, and impurity elements containing the elements that form precipitates combining with O, N or C; and the total content of the precipitate forming elements is 2.5 mass % or less.

(39) An iron-base amorphous alloy thin strip according to the item (37) or (38), characterized in that: Al and/or Ti are contained in said thin strip as said precipitate forming elements; and the contents thereof are in the ranges from 0.01 to 1 mass % as to Al and from 0.01 to 1.5 mass % as to Ti.

(40) An iron-base amorphous alloy thin strip according to the item (37) or (39), characterized in that the contents of said main elements are, in atomic percentage, in the ranges from 78 to 86% as to Fe, from more than 5 to 16% as to B, from 0.02 to 8% as to C, and from 0.2 to 12% in total as to one or more of P, As, Bi, S, Se and Te.

(41) An iron-base amorphous alloy thin strip according to the item (38) or (39), characterized in that the contents of said main elements are, in atomic percentage, in the ranges from 78 to 86% as to Fe, from 0.02 to less than 4% as to Si, from more than 5 to 16% as to B, from 0.02 to 8% as to C, and from 0.2 to 12% in total as to one or more of P, As, Bi, S, Se and Te.

(42) An iron-base amorphous alloy thin strip according to any one of the items (37) to (41), characterized in that the content of Al is in the range from 0.01 to 0.2 mass %.

(43) An iron-base amorphous alloy thin strip according to any one of the items (37) to (42), characterized in that the content of Ti is in the range from 0.01 to 0.4 mass %.

(44) An iron-base amorphous alloy thin strip according to any one of the items (37) to (43), characterized in that the total content of one or more of P, As, Bi, S, Se and Te is in the range from 1 to 12 atomic %.

(45) A wound iron core excellent in alternating current soft magnetic properties, characterized by: being formed by toroidally winding an iron-base amorphous alloy thin strip according to any one of the items (14) to (44); and then being annealed.

(46) A laminated iron core excellent in alternating current soft magnetic properties, characterized by: being formed by punching an iron-base amorphous alloy thin strip according to any one of the items (14) to (44) into sheets of a prescribed shape and laminating the sheets; and then being annealed.

(47) An iron-base mother alloy for producing a rapidly cooled and solidified thin strip, characterized by containing alloying elements of, in atomic percentage, Fe in the range from 77 to 86%, Si in the range from 1.5 to 4.5%, B in the range from 5 to 19%, C in the range from 0.02 to 4%, and P in the range from 0.2 to 16%, and the balance consisting of unavoidable impurities.

(48) An iron-base mother alloy for producing a rapidly cooled and solidified thin strip, characterized by containing alloying elements of, in atomic percentage, Fe in the range from 78 to 86%, Si in the range from 2 to less than 4%, B in the range from 2 to 15%, C in the range from 0.02 to 4%, and P in the range from 1 to 14%, while the content of B+P is maintained in the range from 12 to 20%, and the balance consisting of unavoidable impurities.

(49) An iron-base mother alloy for producing a rapidly cooled and solidified thin strip, characterized by containing alloying elements of, in atomic percentage, Fe in the range from 78 to 86%, B in the range from more than 5 to 16%, C in the range from 0.02 to 8%, and P in the range from 0.2 to 12%, and the balance consisting of unavoidable impurities.

(50) An iron-base mother alloy for producing a rapidly cooled and solidified thin strip, characterized by containing alloying elements of, in atomic percentage, Fe in the range from 78 to 86%, Si in the range from 0.02 to less than 2%, B in the range from more than 5 to 16%, C in the range from 0.02 to 8%, and P in the range from 0.2 to 12%, and the balance consisting of unavoidable impurities.

(51) An iron-base mother alloy for producing a rapidly cooled and solidified thin strip, characterized by containing alloying elements of, in atomic percentage, $Fe_{1-X}Co_X$ (wherein $0.05 \leqq X \leqq 0.4$) in the range from 78 to 86%, Si in the range from 2 to less than 4%, B in the range from more than 5 to 16%, C in the range from 0.02 to 4%, and P in the range from 0.2 to 12%, and the balance consisting of unavoidable impurities.

(52) An iron-base mother alloy for producing a rapidly cooled and solidified thin strip, characterized by containing alloying elements of, in atomic percentage, $Fe_{1-Y}Ni_Y$ (wherein $0.05 \leqq Y \leqq 0.2$) in the range from 78 to 86%, Si in the range from 2 to less than 4%, B in the range from more than 5 to 16%, C in the range from 0.02 to 4%, and P in the range from 0.2 to 12%, and the balance consisting of unavoidable impurities.

(53) An iron-base mother alloy for producing a rapidly cooled and solidified thin strip, characterized by containing alloying elements of, in atomic percentage, Fe in the range from 78 to 86%, Si in the range from 2 to less than 4%, B in the range from more than 5 to 16%, C in the range from 0.02 to 4%, and M in the range from 0.2 to 12%, wherein M indicates one or more of As, Bi, S, Se and Te, and the balance consisting of unavoidable impurities.

(54) An inexpensive iron-base mother alloy for producing a rapidly cooled and solidified thin strip according to any one of the items (47) to (53), characterized in that: Al and/or Ti are contained in said mother alloy; and the contents thereof are in the ranges from 0.01 to 1 mass % as to Al and from 0.01 to 1.5 mass % as to Ti.

BEST MODE FOR CARRYING OUT THE INVENTION

Figure 1:
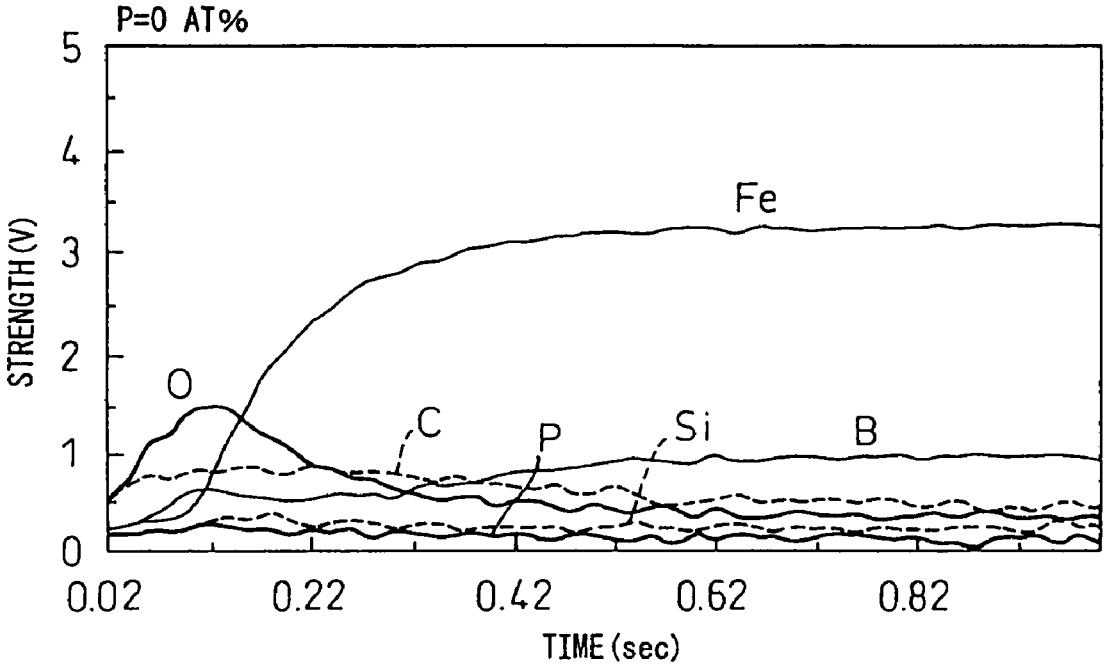
FIG. 1 is a graph showing the GDS profiles of a comparative sample.

An iron-base amorphous alloy thin strip according to the present invention is a metal thin strip produced by rapidly cooling and solidifying molten metal by ejecting it onto a moving cooling substrate through a pouring nozzle having a slot-shaped opening; it is cast through a process such as the single-roll or twin-roll process. Such an iron-base amorphous alloy thin strip contains P in the range from 0.2 to 12 atomic % in the amorphous mother phase thereof and has an ultra-thin oxide layer of a thickness in the range from 5 to 20 nm on one or both of the surfaces of the amorphous mother phase.

P contained in an amorphous mother phase is added deliberately as one of main alloying elements beyond the range of the amount of P included as an impurity element. By the addition of P, a stress relieving effect grows and therefore the optimum temperature range for obtaining excellent soft magnetic properties expands when a thin strip is annealed. In addition, the stress relieving effect also allows magnetic domain walls to displace more easily and thus hysteresis loss decreases.

When a P content in a mother phase is less than 0.2 atomic %, the effect of expanding the optimum annealing temperature range is not obtained. When P is added in excess of 12 atomic %, on the other hand, no further effect of adding P is obtained and, what is worse, a magnetic flux density decreases. When a P content is in the range from 1 to 12 atomic %, the effect of adding P shows up more efficiently, and, when a P content is in the range from 1 to 10 atomic %, then the decrease in a magnetic flux density is further suppressed and a better effect is obtained.

An adequate thickness of an ultra-thin oxide layer formed on one or both of the surfaces of the amorphous mother phase of a thin strip is in the range from 5 to 20 nm. An oxide layer forms on each of the surfaces of an amorphous alloy thin strip in the process of casting the thin strip in air, and the thickness of the oxide layer varies in accordance with the temperature of the thin strip and the atmosphere around it. The present inventors have confirmed through tests that, when the thickness of an oxide layer is in the range as small as from 5 to 20 nm, an excellent core loss reduction effect is obtained owing to the effect of fining the magnetic domains in the amorphous mother phase.

The reason for the above is presumably that, when the thickness of an ultra-thin oxide layer is less than 5 nm, a uniform oxide layer hardly forms and, as a result, the fining of magnetic domains does not occur. It is also presumed that the fining of magnetic domains is caused by tension imposed on a thin strip by an ultra-thin oxide layer. It is estimated that tension is imposed on a thin strip owing to the volume expansion of the surface layer since an ultra-thin oxide layer is formed by oxygen intruding into the surface layer of a thin strip from outside. Therefore, as the thickness of an ultra-thin oxide layer increases, tension increases and the core loss of the thin strip decreases. In the tests, however, when the thickness of an ultra-thin oxide layer exceeded 20 nm, no further core loss reduction effect was obtained.

Further, an iron-base amorphous alloy thin strip according to the present invention is a thin strip having a segregation layer containing P and/or S between the ultra-thin oxide layer and the amorphous mother phase. When an iron-base amorphous alloy thin strip has such a segregation layer, the core loss thereof becomes lower than that of a thin strip having only an ultra-thin oxide layer. Further, hysteresis loss decreases as the thickness of an ultra-thin oxide layer increases. It is estimated that hysteresis loss decreases because a segregation layer containing P and/or S forms between an ultra-thin oxide layer and an amorphous mother phase and the formed segregation layer makes the interface between the two smooth and the displacement of magnetic domain walls easier. This effect becomes significant when the thickness of a segregation layer is 0.2 nm or more, but no greater effect can be expected when the thickness thereof is more than 15 nm. When a segregation layer is formed, a core loss reduction effect is maintained until the thickness of an ultra-thin oxide layer comes close to 100 nm or so.

Furthermore, an iron-base amorphous alloy thin strip according to the present invention is a thin strip wherein the ultra-thin oxide layer of the thin strip has a bilaminar structure. By increasing the oxygen concentration in the atmosphere of thin strip casting or raising the temperature of a thin strip when it peels off from a cooling roll, it is possible to make an ultra-thin oxide layer not only thicker but also bilaminar and, as a consequence, reduce the core loss of the thin strip still further.

In a thin strip having an ultra-thin oxide layer of a bilaminar structure according to the present invention, when a lamina at the outermost surface is defined as the first oxide lamina and the other lamina between the first oxide lamina and the amorphous mother phase is defined as the second oxide lamina, the second oxide lamina is composed of amorphous oxide and the first oxide lamina may be composed of amorphous oxide, crystalline oxide or a mixture of the two.

The structure of the first oxide lamina can be changed by changing casting conditions; as an Fe amount in the first oxide lamina increases, the crystallization of the lamina advances from an amorphous structure to a mixture of amorphous and crystalline structures and then to a crystalline structure. As the crystallization of the first oxide lamina advances, a core loss reduction effect increases. An Fe amount in the first oxide lamina can be increased by raising the oxygen concentration in the atmosphere of thin strip casting and the peel-off temperature of a thin strip, or adding elements as explained later.

The second oxide lamina retains the amorphous state regardless of casting conditions. This is presumably because the lamina contains more Si and B than the first oxide lamina does.

A core loss decreases as the total thickness of a bilaminar ultra-thin oxide layer increases. This is because the ultra-thin oxide layer imposes tension on a thin strip, makes magnetic domains fine, and reduces eddy current loss as a result. As the thickness of an oxide layer increases, the tension imposed on a thin strip increases, magnetic domains refine, and thus eddy current loss decreases. The roles of the two laminas are considered as follows: the first oxide lamina into which oxygen intrudes easily expands in the first place and create tension; and the second oxide lamina transmits the tension to a mother phase and prevents the first oxide lamina from peeling off from the mother phase.

Therefore, a core loss decreases as the thickness of the first oxide lamina increases. When the thickness of the first oxide lamina is excessive compared with the second oxide lamina, however, a core loss reduction effect decreases. This is presumably because tension increases excessively, an ultra-thin oxide layer peels off partially from a mother phase and, thus, the tension imposed on the mother phase disappears. Further, a core loss tends to decrease as the structure of the first oxide lamina changes from an amorphous structure to a crystalline structure as described above. This is presumably because, as crystallization advances, the rigidity of the first oxide lamina increases and tension imposed on a mother phase increases as a result.

When one or more elements of P, As, Sb, Bi, S, Se and Te are added to a thin strip having a bilaminar oxide layer according to the present invention, the added elements segregate in the second oxide lamina. The amount of the segregation can be changed by controlling the addition amount of the elements, the peel-off temperature of a thin strip and the oxygen concentration in a casting atmosphere.

The elements segregating in the second oxide lamina have the effect of accelerating the growth of the first oxide lamina and thus reducing the eddy current loss of a thin strip. Whereas the valence of an Fe ion is +2 or +3 in oxide, that of an ion of P, As, Sb or Bi, which is a Group V element, is +5, and that of an ion of S, Se or Te, which is a Group VI element, is +6. Thus, an ion of any of these elements has a higher valence than an Fe ion does.

When any of these elements is replaced with Fe and enters into the second oxide lamina of an ultra-thin oxide layer, electric charge balance is disturbed and metal ion defects (Fe ion defects) increase for mitigating the disturbance. In that case, presumably, metal ions are liable to diffuse from an amorphous mother phase to the first oxide lamina through the second oxide lamina having an increased number of defects and thus the growth of the first oxide lamina is accelerated. In addition, as a result of the increase of an Fe amount in the first oxide lamina, the first oxide lamina is liable to crystallize.

As a consequence, tension imposed on a thin strip increases, magnetic domains refine and an eddy current loss decreases. Besides, the addition of one or more of P, As, Sb, Bi, S, Se and Te has the effect of reducing hysteresis loss. It is estimated that the effect shows up because the interface between a second oxide lamina and an amorphous mother phase is made smooth and the displacement of magnetic domain walls is made easier.

While a P content in a mother phase is regulated in the range from 0.2 to 12 atomic % as specified earlier, one or more of As, Sb, Bi, S, Se and Te may be added in addition to or in place of P. In that case, the total amount of them may be in the range from 0.2 to 12 atomic %. Among those elements, the use of S together with P is particularly desirable because of the low price.

Still further, it is desirable that the crystalline oxide composing a part of an ultra-thin oxide layer is Fe oxide having a spinel structure. As a result of investigating the structure of the oxide of a first oxide lamina wherein crystallization advanced, it was found that the oxide structure was a spinel structure mainly composed of $Fe_3O_4$ or $\gamma$-$Fe_2O_3$. Oxide of such a structure can effectively impose tension on a mother phase.

Note that it is desirable that the total thickness of a bilaminar ultra-thin oxide layer is in the range from 5 to 20 nm. When a thickness is less than 5 nm, an ultra-thin oxide layer hardly forms a laminar structure. On the other hand, when a thickness exceeds 20 nm, no further core loss reduction effect shows up. It is desirable that the thickness of a first oxide lamina is in the range from 3 to 15 nm. When a thickness is less than 3 nm, a core loss reduction effect is insignificant. On the other hand, when a thickness exceeds 15 nm, a core loss reduction effect does not increase any more. It is desirable that the thickness of a second oxide lamina is in the range from 2 to 10 nm. When a thickness is less than 2 nm, a core loss reduction effect is insignificant. On the other hand, when a thickness exceeds 10 nm, the amount of Fe diffusing across the second oxide lamina decreases and, as a result, the growth of the first oxide lamina, which create a large tension, is hindered.

In an aforementioned thin strip according to the present invention, an ultra-thin oxide layer and a segregation layer are not necessarily required to form on both the surfaces of the thin strip and a core loss reduction effect is obtained as long as they form on either surface. However, it is desirable that an ultra-thin oxide layer forms on the surface of a thin strip at least on the side not touching a cooling substrate. This is because, in the above case, the thickness of an ultra-thin oxide layer is easily controlled during the casting of a thin strip but, in the other case, air pockets form on the surface touching a cooling substrate and thus an ultra-thin oxide layer hardly forms uniformly.

Further, it is desirable that an ultra-thin oxide layer consists of Fe oxide, Si oxide, B oxide or a composite of these oxides. Among those, it is particularly desirable that the oxide layer consists mainly of Fe and Si oxides. By forming those oxides on the surface of a thin strip at a high temperature above room temperature, an optimum tension is imposed on an amorphous mother phase and core loss is reduced effectively owing to the fining of magnetic domains.

A desirable thickness of a thin strip according to the present invention is in the range from 10 to 100 μm. This is because, when the thickness of a thin strip is less than 10 μm, stable casting of the thin strip is hardly secured and, when the thickness of a thin strip is more than 100 μm on the other hand, stable casting of the thin strip is also hardly secured and, in addition, the thin strip becomes brittle. A more desirable thickness range is from 10 to 70 μm; in this thickness range, more stable casting is secured. The width of a thin strip is not specified in the present invention, but a width of 20 mm or more is desirable.

It is desirable that the chemical components (in atomic percentage and so on unless otherwise specified) of an iron-base amorphous alloy thin strip and the mother alloy which is the basis of the thin strip according to the present invention are, besides P in the range from 0.2 to 16% as described earlier, Fe in the range from 70 to 86%, Si in the range of 19% or less, B in the range from 2 to 20%, and C in the range from 0.02 to 8%. P may be partially replaced with one or more of As, Sb, Bi, S, Se and Te. To give some typical examples, it is desirable to use an Fe—Co alloy for obtaining a thin strip having a high magnetic flux density, an Fe—Ni alloy for improving the brittleness of a thin strip, and an Fe—(Si)—B—P alloy for uniformalizing the core loss property along the width direction, the surface condition and the thickness of a thin strip. The desirable chemical compositions according to the present invention are described more specifically hereafter.

1) An iron-base amorphous alloy thin strip and the mother alloy thereof consist of the main elements of Fe, Co, Si, B, C and P and unavoidable impurities, and the contents of the main elements are in the ranges from 78 to 86%, preferably from more than 80 to 82%, as to $Fe_{1-X}Co_X$ (wherein $0.05 \leqq X \leqq 0.4$), from 2 to less than 4% as to Si, from more than 5 to 16% as to B, from 0.02 to 4% as to C; and from 0.2 to 12% as to P.

2) An iron-base amorphous alloy thin strip and the mother alloy thereof consist of the main elements of Fe, Ni, Si, B, C and P and unavoidable impurities, and the contents of the main elements are in the ranges from 78 to 86%, preferably from more than 80 to 82%, as to $Fe_{1-Y}Ni_Y$ (wherein $0.05 \leqq Y \leqq 0.2$), from 2 to less than 4% as to Si, from more than 5 to 16% as to B, from 0.02 to 4% as to C, and from 0.2 to 12% as to P.

3) An iron-base amorphous alloy thin strip and the mother alloy thereof consist of the main elements of Fe, Si, B, C and P and unavoidable impurities, and the contents of the main elements are in the ranges from 78 to 86% as to Fe, from 2 to less than 4% as to Si, from 2 to 15% as to B, from 0.02 to 4% as to C, and from 1 to 14% as to P, while the content of B+P is maintained in the range from 12 to 20%.

4) An iron-base amorphous alloy thin strip and the mother alloy thereof consist of the main elements of Fe, B, C and P and unavoidable impurities, and the contents of the main elements are in the ranges from 78 to 86% as to Fe, from more than 5 to 16% as to B, from 0.02 to 8% as to C, and from 0.2 to 12%, preferably from 1 to 12%, as to P.

5) An iron-base amorphous alloy thin strip and the mother alloy thereof consist of the main elements of Fe, Si, B, C and P and unavoidable impurities, and the contents of the main elements are in the ranges from 78 to 86% as to Fe, from 0.02 to less than 2% as to Si, from more than 5 to 16% as to B, from 0.02 to 8% as to C, and from 0.2 to 12%, preferably from 1 to 12%, as to P.

6) An iron-base amorphous alloy thin strip and the mother alloy thereof consist of the main elements of Fe, Si, B, C and M and unavoidable impurities, wherein M indicates one or more of As, Sb, Bi, S, Se and Te, and the contents of the main elements are in the ranges from 78 to 86% as to Fe, from 2 to less than 4% as to Si, from more than 5 to 16% as to B, from 0.02 to 4% as to C, and from 0.2 to 12%, preferably from 1 to 12%, as to M.

7) An iron-base amorphous alloy thin strip and the mother alloy thereof consist of the main elements of Fe, Si, B, C and P+M and unavoidable impurities, wherein M indicates one or more of As, Sb, Bi, S, Se and Te, and the contents of the main elements are in the ranges from 78 to 86% as to Fe, from 2 to less than 4% as to Si, from more than 5 to 16% as to B, from 0.02 to 4% as to C, and from 0.2 to 12%, preferably from 1 to 12%, as to P+M.

8) An iron-base amorphous alloy thin strip and the mother alloy thereof comprise: the main elements of a group of Fe, B and C, or a group of Fe, Si, B and C, and one or more of As, Sb, Bi, S, Se and Te; and the elements that form precipitates combining with O, N or C, and the total content of the precipitate forming elements is 2.5 mass % or less.

9) An iron-base amorphous alloy thin strip and the mother alloy thereof having the chemical components according to the item 8) further contain Al and/or Ti as the precipitate forming elements, and the contents thereof are in the ranges from 0.01 to 1 mass %, preferably from 0.01 to 0.2 mass %, as to Al and from 0.01 to 1.5 mass %, preferably from 0.01 to 0.4 mass %, as to Ti.

10) An iron-base amorphous alloy thin strip and the mother alloy thereof consist of the main elements of Fe, Si, B, C and P and unavoidable impurities, and the contents of the main elements are in the ranges from 78 to 86% as to Fe, from more than 5 to 16% as to B, from 0.02 to 8% as to C, and from 0.2 to 12%, preferably from 1 to 12%, in total as to one or more of P, As, Sb, Bi, S, Se and Te.

11) An iron-base amorphous alloy thin strip and the mother alloy thereof consist of the main elements of Fe, Si, B, C and P and unavoidable impurities, and the contents of the main elements are in the ranges from 78 to 86% as to Fe, from 0.02 to less than 4% as to Si, from more than 5 to 16% as to B, from 0.02 to 8% as to C, and from 0.2 to 12%, preferably from 1 to 12%, in total as to one or more of P, As, Sb, Bi, S, Se and Te.

12) An iron-base amorphous alloy thin strip and the mother alloy thereof consist of the main elements of Fe, Si, B, C and P and unavoidable impurities, and the contents of the main elements are in the ranges from 77 to 86% as to Fe, from 1.5 to less than 4.5% as to Si, from more than 5 to 19% as to B, from 0.02 to 8% as to C, and from 0.2 to 16%, preferably from 1 to 12%, as to P.

An Fe content of a thin strip must be 70 atomic % or more since a saturation magnetic flux density is required to be as high as 1.5 T or more when the thin strip is used for an iron core. When an Fe content exceeds 86 atomic %, however, an amorphous structure hardly forms.

Si and B are elements for enhancing amorphous structure forming capacity and thermostability. When contents of Si and B are less than the respective content ranges specified above, stable formation of an amorphous structure is hardly obtained. However, even if contents of Si and B exceed their respective content ranges, merely material costs increase and amorphous structure forming capacity and thermostability are not enhanced any further.

C is an element effective for improving the castability of a thin strip. By containing C in the above content range, wettability between a cooling substrate and molten metal improves and a good thin strip can be cast.

For stabilizing magnetic properties still further, it is desirable to control the contents of Fe in the range from 78 to 86 atomic %, Si in the range from 2 to less than 4 atomic %, and B in the range from more than 5 to 16 atomic %. Further, by controlling the contents of Fe in the range from more than 80 to 82 atomic % and B in the range from more than 5 to 14 atomic %, a core loss reduction effect by the formation of an ultra-thin oxide layer improves.

A thin strip according to the present invention can be produced not only by using a single-roll casting apparatus, but also by using a twin-roll casting apparatus, a centrifugal rapid cooling apparatus that uses the inner surface of a rotating drum, or a casting apparatus that uses an endless belt.

The thickness and the structure of an ultra-thin oxide layer can be examined by TEM observation on a sectional surface of a thin strip. In addition, the contents and the segregation states of various elements in an oxide layer can be examined from their distribution profiles in the depth direction measured by surface analysis methods such as glow discharge spectroscopy (GDS) and SIMS.

An iron-base amorphous alloy thin strip according to the present invention is a thin strip to which a prescribed amount of P is added and either a small amount of Si or no Si is added, while the contents of Fe, B and C are limited in respective ranges. By controlling such chemical components as specified above, even when temperature unevenness occurs at different portions of an iron core during the annealing of the iron core after it is formed by laminating a thin strip, a magnetic flux density after the annealing is significantly improved and the fluctuation of the magnetic flux densities at different portions of the iron core is small. In addition, by so doing, an optimum annealing temperature range can be expanded and, even when a lower annealing temperature is applied, excellent magnetic properties can be secured and the embrittlement of a thin strip caused by annealing is suppressed.

In the present invention, with regard to a magnetic flux density after annealing: a maximum magnetic flux density $B_{80}$ is measured when a maximum alternating current magnetic field of 80 A/m is imposed at a frequency of 50 Hz; and the fluctuation of magnetic flux densities caused by temperature unevenness during annealing at different portions of an iron core is evaluated in terms of the standard deviation of the values of $B_{80}$ and an annealing temperature range $\Delta T_A$ defined as $\Delta T_A = T_A max - T_A min$, wherein $T_A max$ and $T_A min$ represent respectively the maximum and minimum annealing temperatures between which excellent soft magnetic properties are secured.

In addition, a core loss after annealing is measured and the fluctuation of core losses at different portions of an iron core caused by aforementioned temperature unevenness is evaluated in terms of the annealing temperature range $\Delta T_b$ defined as $\Delta T_{=TB} max - T_B min$, wherein $T_B max$ and $T_B min$ represent respectively the maximum and minimum annealing temperatures between which an excellent core loss characteristic is secured.

The embrittlement characteristic of a thin strip caused by annealing is judged in terms of the value of the fracture strain $\epsilon_f$ of the thin strip defined as $\epsilon_f = t/(D_f - t)$, wherein t represents the thickness of an annealed thin strip subjected to 180° bend test and $D_f$ the diameter of the bend at the time when the thin strip fractures.

The reasons for limiting chemical components are explained hereafter.

A content of Fe must be in the range from 78 to 86 atomic %. When an Fe content is less than 78 atomic %, a magnetic flux density high enough for an iron core is not obtained and, when it exceeds 86 atomic %, an amorphous structure hardly forms and good magnetic properties are not obtained.

Further, by controlling an Fe content to more than 80 atomic %, excellent soft magnetic properties such as 1.35 T or more in $B_{80}$ are obtained more stably after annealing at a temperature in a wider temperature range or a lower temperature range. In addition, by controlling an Fe content to 82 atomic % or less, an amorphous structure forms more stably and an excellent embrittlement resistance such as 0.01 or more in $\epsilon_f$ is obtained more stably.

Si is either not added or added in the range from 0.02 to less than 4 atomic %. In the case of the addition of Si, the lower limit of 0.02 atomic % is set forth as an amount exceeding the amount contained unavoidably as an impurity element. With a chemical composition according to the present invention, an amorphous structure forms stably by the effect of P addition whether Si is not added or Si is added in the range of less than 4 atomic %. This is because the addition of C in the range specified below causes the effect of the lower limit of an Si content described in the prior invention and makes it possible to stably produce a good amorphous thin strip. When an Si content is not less than 4 atomic %, the aforementioned effect of adding one or more of P, As, Bi, S, Se and Te as a part of main elements is hardly obtained.

A content of C must be in the range from 0.02 to 8 atomic %. C is an element effective for enhancing the castability of a thin strip. By containing C in the range of 0.02 atomic % or more, the wettability between a cooling substrate and molten metal improves and a good amorphous thin strip can be produced stably. However, even if a C content exceeds 8 atomic %, the effect does not grow further.

Note that, whereas a C content is limited in the range from 0.02 to 4 atomic % in the prior invention, a amount of (Si+C) is allowed to be in the range from 0.02 to less than 8 atomic % in the present invention, because an Si content is limited in the range described above in the present invention.

A content of B must be in the range from more than 5 to 16 atomic %. When a B content is 5 atomic % or less, stable formation of an amorphous structure is hardly secured. When a B content exceeds 16 atomic %, on the other hand, no further enhancement of the amorphous structure forming capacity is obtained. In addition, by controlling a B content to less than 14 atomic %, "the effect of P addition on the expansion of an optimum annealing temperature range" or "the effect of P addition on the expansion of an annealing temperature range toward lower temperature side" shows up more effectively. That is to say, when a B content is controlled in the range from more than 5 to less than 14 atomic %, an amorphous alloy thin strip having excellent soft magnetic properties such as a low fluctuation of the values of $B_{80}$ and an excellent embrittlement resistance such as 0.01 or more in $\epsilon_f$ is obtained.

A content of P must be in the range from 0.2 to 12 atomic %. P is the most important element in the present invention. The present inventors have already disclosed in Japanese Unexamined Patent Publication No. H9-202946 that an addition of P in the range from 0.008 to 0.1 mass % (0.16 atomic %) causes the effect of increasing the permissible contents of Mn and S and, as a result, allowing the use of an inexpensive iron source. However, the present invention is the one that prevents the deterioration of soft magnetic properties caused by temperature unevenness even when temperature unevenness occurs at different portions of an iron core during the annealing thereof by means of adding an adequate amount of P exceeding the amount specified in the above patent publication. Further, by so doing, the present invention makes it easy to anneal an iron core at a temperature lower than the temperature at which the embrittlement of the iron core shows up.

When a P content is less than 0.2 atomic %, neither the effect on the expansion of an optimum annealing temperature range nor the effect on the expansion of an annealing temperature range toward the lower temperature side is obtained. However, when a P content exceeds 12 atomic %, the effect of P addition is not increased any longer and, what is worse, a magnetic flux density deteriorates.

Further, by controlling a P content to 1 atomic % or more, the effect of P on the reduction of the fluctuation of magnetic flux densities $B_{80}$ is further strengthened and, at the same time, the values of $B_{80}$ of 1.35 T or more and $\epsilon_f$ of 0.01 or more are secured stably. That is to say, as long as a P content is in the range from 1 to 12 atomic %, the decrease in a magnetic flux density is suppressed and the effects of P addition are intensified.

Further, no particular problem occurs with an iron-base amorphous alloy thin strip according to the present invention even when it contains elements such as Mn and S in such amounts as specified as unavoidable impurities in Japanese Unexamined Patent Publication No. H9-202946.

What is important in specifying the ranges of chemical components is that: the effects of P in the present invention are achieved by adding a prescribed amount of P to an alloy of an Fe—Si—B—C system having chemical components in limited ranges; in particular, the effects of the P addition are realized only when Si is in a low content range; and, as long as C is added by 0.02 atomic % or more, Si may either not be added or may be added by less than 2 atomic %.

As a result of limiting the chemical components of a thin strip according to the present invention as described above, magnetic flux densities $B_{80}$ at different portions of an iron core annealed after fabricated in a wound or laminated form are 1.35 T or more and thus a magnetic flux density improvement effect is recognized. At the same time, such excellent soft magnetic properties that the standard deviation of $B_{80}$ is less than 0.1 and such a property that the above-mentioned annealing temperature range $\Delta T_A$ defined as $\Delta T_A = T_A max - T_A min$ is at least 80° C. are secured and, therefore, temperature unevenness can be overcome even in a wide temperature range.

Further, such a core loss property that a core loss after annealing is 0.12 W/kg or less and such a property that the above-mentioned annealing temperature range $\Delta T_B$ defined as $\Delta T_B = T_B max - T_B min$ is at least 60° C. are secured, and therefore temperature unevenness can be overcome even in a wide temperature range.

Furthermore, a thin strip according to the present invention exhibits, after annealing, such an excellent embrittlement resistance that a fracture strain $\epsilon_f$ defined as $\epsilon_f = t/(D_f - t)$ is 0.01 or more.

As a consequence, both a wound iron core, manufactured by toroidally winding a thin strip according to the present invention and then annealing it, and a laminated iron core, manufactured by punching a thin strip according to the present invention into sheets of a prescribed shape, laminating the sheets and then annealing it, are excellent in alternating current soft magnetic properties.

An iron-base amorphous alloy thin strip according to the present invention is the one that: consists of main elements and impurity elements; and is produced by adding one or more of P, As, Bi, S, Se and Te to an alloy of an Fe—B—C or Fe—B—C—Si system as the main elements so as to suppress crystallization during the casting of the thin strip and avoid the deterioration of a core loss and other properties even when the elements that form precipitates combining with O, N or C are included within a range of 2.5 mass % or less in total as impurity elements.

The precipitate forming elements are those that easily form precipitates combining with O, N or C and concretely are Al, Ti, Zr, V, Nb, etc. In particular, the adoption of Al and/or Ti is effective practically. Since Al deoxidation is widely adopted and Ti is also adopted as a deoxidizing agent or an additive element in a steel produced through ordinary steelmaking processes recently, the capability of adopting a steel containing those elements as the iron source for producing a thin strip is effective for reducing raw material costs. When those precipitate forming elements are contained in excess of 2.5 mass % in total, a core loss deteriorates beyond a prescribed value. Therefore, the total amount of precipitate forming elements is limited to 2.5 mass % or less.

The reasons for desirably limiting the chemical components in the present invention are explained hereunder.

It is desirable that a content of Al is in the range from 0.01 to 1 mass %. When an Al content is less than 0.01 mass %, a cost reduction effect is hardly obtained. However, even when an Al content exceeds 1 mass %, an additional cost reduction effect is little obtained. Further, an Al content of 0.2 mass % or less is more desirable for securing a low core loss more stably.

It is desirable that a content of Ti is in the range from 0.01 to 1.5 mass %. When a Ti content is less than 0.01 mass %, a cost reduction effect is hardly obtained. However, even when a Ti content exceeds 1.5 mass %, an additional cost reduction effect is hardly obtained. Further, a Ti content of 0.4 mass % or less is more desirable for securing a low core loss more stably.

P, As, Bi, S, Se and Te are the most important of the elements in the present invention. It is desirable that the total content of one or more of those elements is in the range from 0.2 to 12 atomic %, and more desirably from 1 to 12 atomic %.

As mentioned earlier, the present inventors have disclosed in Japanese Unexamined Patent Publication No. H9-202946 that, when a thin strip contains a small amount of P in the range from 0.008 to 0.1 mass % (0.16 atomic %) as an impurity element, the permissible contents of Mn and S increase and therefore the use of an inexpensive iron source is made possible. In the present invention, however, P is added intentionally as one of the main elements. The addition of P brings about an effect of significantly suppressing crystallization caused by precipitate forming elements such as Al and Ti during casting. A similar effect is obtained by the addition of any of As, Bi, S, Se and Te. The desirable total addition amount of one or more of these elements according to the present invention exceeds the P content specified in the above-mentioned patent publication.

When the total content of one or more of these elements is less than 0.2 atomic %, the effect of suppressing crystallization as mentioned above is insignificant. However, even when the total content thereof exceeds 12 atomic %, the effect of expanding the range of the permissible amounts of precipitate forming elements is not secured any more and, what is worse, there arises a danger of deteriorating the magnetic flux density of a thin strip. By controlling the total content of one or more of these elements to 1 atomic % or more, the effect of suppressing the fluctuation of magnetic flux densities is intensified and the effect of suppressing the embrittlement of a thin strip is obtained more stably.

EXAMPLE

Example 1

Amorphous thin strips having the chemical composition of $Fe_{80.4}Si_{2.5}B_{9.4}P_{6.4}C_{1.3}$ (in atomic percentage) were cast through the single-roll process. The casting was done in a chamber capable of controlling the atmosphere, and the thicknesses of the ultra-thin oxide layers were changed by changing the oxygen concentrations in the casting atmosphere. The cooling roll was made of a copper alloy and had an outer diameter of 300 mm. The width of the thin strips was 25 mm. The thicknesses of the ultra-thin oxide layers were measured from the concentration profiles of elements obtained by GDS (glow discharge spectroscopy, at a sputtering speed of 50 nm/sec.).

Each of the thin strips was annealed at a temperature of 360° C. for 1 h. in a nitrogen atmosphere while a magnetic field was applied, and thereafter the core loss W13/50 was measured under a maximum magnetic flux density of 1.3 T and a frequency of 50 Hz by using a single strip tester (SST). The thicknesses of the ultra-thin oxide layers little changed before and after the annealing. The measurement results are shown in Table 1.

The invention samples Nos. 2 to 8 having the ultra-thin oxide layers which thicknesses were in the range from 5 to 20 nm showed distinctly lower core losses than the comparative sample No. 1 having the ultra-thin oxide layers which thicknesses were less than 5 nm. It was noted that the comparative sample No. 1 was cast in an atmosphere of an ultra-low oxygen concentration. The comparative samples Nos. 9 and 10 having the ultra-thin oxide layers which thicknesses were more than 20 nm showed core losses as high as the core loss of the comparative sample No. 1.

The invention sample No. 2-a was prepared by etching and removing the ultra-thin oxide layer on the roll-side surface of the thin strip of the invention sample No. 2 with the free-side surface thereof masked, and the invention sample No. 2-b was prepared by removing the ultra-thin oxide layer on the free-side surface likewise. From the fact that the core losses were substantially identical in the samples Nos. 2, 2-a and 2-b, it was understood that it was sufficient if an ultra-thin oxide layer was formed on either of the surfaces of a thin strip.

TABLE 1

| No. | Classification | Thin strip thickness (μm) | Ultra-thin oxide layer thickness (nm): Surface not contacting cooling substrate (free-side surface) | Ultra-thin oxide layer thickness (nm): Surface contacting cooling substrate (roll-side surface) | Core loss $W_{13/50}$ (W/kg) |
|---|---|---|---|---|---|
| 1 | Comparative sample | 25 | 4.1 | 3.8 | 0.132 |
| 2 | Invention sample | 25 | 5.3 | 5.2 | 0.102 |
| 2-a | Invention sample | 24 | 5.3 | 0 | 0.100 |
| 2-b | Invention sample | 27 | 0 | 5.2 | 0.103 |
| 3 | Invention sample | 27 | 6.5 | 6.2 | 0.092 |
| 4 | Invention sample | 26 | 8.4 | 8.3 | 0.071 |
| 5 | Invention sample | 27 | 10.6 | 9.5 | 0.063 |
| 6 | Invention sample | 28 | 14.5 | 14.2 | 0.079 |
| 7 | Invention sample | 30 | 16.4 | 16.1 | 0.091 |
| 8 | Invention sample | 32 | 19.4 | 19.1 | 0.108 |
| 9 | Comparative sample | 29 | 22.1 | 20.8 | 0.131 |
| 10 | Comparative sample | 26 | 24.1 | 23.9 | 0.135 |

Example 2

Amorphous thin strips having the chemical composition of $Fe_{80.7}Si_{2.6}B_{15.7-x}P_xC_{1.0}$ (in atomic percentage), wherein the value of X was changed from 0 to 15, were cast in the normal atmosphere through the single-roll process. The cooling roll was made of a copper alloy and had an outer diameter of 600 mm. The width of the thin strips was 25 mm and the thickness thereof was 27 μm. The thicknesses of the ultra-thin oxide layers were measured in the same manner as in Example 1. The thin strips were annealed in the same manner as in Example 1 and the core losses thereof were measured also in the same manner as in Example 1. The results are shown in Table 2.

The invention samples Nos. 12 to 18 containing P in the range from 0.2 to 12 atomic % showed distinctly lower core losses than the comparative sample No. 11 not containing P in the mother phase. As far as a P content was in the range specified in the present invention, ultra-thin oxide layers having nearly identical thicknesses in the range from 9 to 11 nm were formed without depending on a P content. The comparative samples Nos. 19 and 20 having P contents exceeding 12 atomic % showed low magnetic flux densities. It was noted that the amounts of P in the mother phases of the thin strips varied in accordance with the amounts of P added to the mother alloys.

Figure 2:
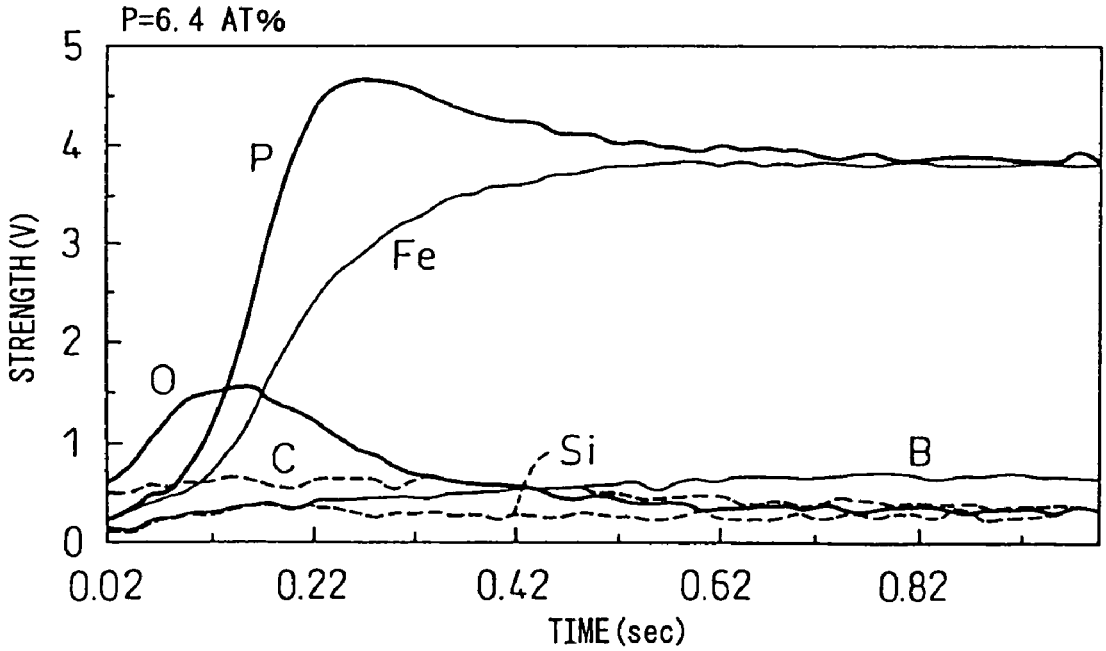
FIG. 2 is a graph showing the GDS profiles of a sample according to the present invention.

FIGS. 1 and 2 show the GDS profiles of the constituent elements of the samples Nos. 11 and 15, respectively. The portions where the O concentrations were high corresponded to the ultra-thin oxide layers. It was understood from FIG. 2 that, in the case of the sample No. 15 having a P content in the range specified in the present invention, P of a high concentration was contained also in the mother phase and the segregation of P was observed at the mother phase side of the ultra-thin oxide layer.

TABLE 2

| No. | Classification | P content in mother phase (at. %) | Ultra-thin oxide layer thickness (nm): Surface not contacting cooling substrate (free-side surface) | Ultra-thin oxide layer thickness (nm): Surface contacting cooling substrate (roll-side surface) | Core loss $W_{13/50}$ (W/kg) |
|---|---|---|---|---|---|
| 11 | Comparative sample | 0 | 3.9 | 3.7 | 0.131 |
| 12 | Invention sample | 0.3 | 9.4 | 9.3 | 0.082 |
| 13 | Invention sample | 1.2 | 9.5 | 9.4 | 0.072 |
| 14 | Invention sample | 3.5 | 9.8 | 9.4 | 0.070 |
| 15 | Invention sample | 6.4 | 10.2 | 9.9 | 0.065 |
| 16 | Invention sample | 9.7 | 10.1 | 9.9 | 0.067 |
| 17 | Invention sample | 10.5 | 10.9 | 10.7 | 0.069 |
| 18 | Invention sample | 11.8 | 11.0 | 10.8 | 0.089 |
| 19 | Comparative sample | 13.6 | 11.0 | 10.9 | 0.090 |
| 20 | Comparative sample | 14.8 | 11.1 | 11.0 | 0.098 |

Example 3

Amorphous thin strips having the chemical composition of $Fe_{80.4}Si_{2.5}B_{10}P_{6.1}C_1$ (in atomic percentage) with 0.007 mass % S added were cast through the single-roll process in the same manner as in Example 1. The thicknesses of the segregation layers were changed by changing the cooling rates of the thin strips. The thicknesses of each ultra-thin oxide layer and each segregation layer were measured in the same manner as in Example 1. The thin strips were annealed in the same manner as in Example 1 and the core losses thereof were measured also in the same manner as in Example 1. The results are shown in Table 3.

It was confirmed from GDS profiles (not given) that P and S segregated at the mother phase side of each ultra-thin oxide layer. In addition, from the fact that the peaks of Fe, Si and B were observed at the position coinciding with the peak of O, it was clarified that an ultra-thin oxide layer containing oxides of Fe, Si and B systems was formed. As a result of analyzing P in a mother phase after removing an ultra-thin oxide layer by etching, the P content was 6.1 atomic %, which was equal to the value obtained in the analysis of the entire thin strip. This was because the amount of P in an ultra-thin oxide layer accounted for only a small fraction of the amount of P in the entire thin strip.

From the results shown in Table 3, it was understood that the invention samples Nos. 22 to 27 having the segregation layers which thicknesses were 0.2 nm or more showed distinctly lower core losses than the comparative sample No. 21 having the segregation layers which thicknesses were less than 0.2 nm. As the thickness of a ultra-thin oxide layer approached 20 nm, a core loss began to increase. However, as it was understood by comparing the sample No. 27 with the sample No. 8 in Table 1, the increase in core loss was suppressed in the invention sample having segregation layers. In the comparative sample No. 28, the thicknesses of the ultra-thin oxide layers exceeded 20 nm and no core loss reduction effect was seen.

The samples Nos. 23-a and 23-b were prepared by removing the ultra-thin oxide layers and the segregation layers on either of the surfaces in the same manner as in the samples Nos. 2-a and 2-b in Example 1. It was understood from these samples that it was sufficient if an ultra-thin oxide layer and a segregation layer were formed on either of the surfaces of a thin strip.

TABLE 3

| No. | Classification | Thin strip thickness (μm) | Thicknesses of ultra-thin oxide layer and segregation layer: Surface not contacting cooling substrate (free-side surface): Ultra-thin oxide layer | Segregation layer | Kind of segregation layer | Surface contacting cooling substrate (roll-side surface): Ultra-thin oxide layer | Segregation layer | Kind of segregation layer | Core loss $W_{13/50}$ (W/kg) |
|---|---|---|---|---|---|---|---|---|---|
| 21 | Comparative sample | 24 | 3.9 | 0.1 | P, S | 3.7 | 0.1 | P, S | 0.131 |
| 22 | Invention sample | 26 | 5.3 | 2.2 | P, S | 5.2 | 2.1 | P, S | 0.100 |
| 23 | Invention sample | 26 | 6.9 | 4.2 | P, S | 6.8 | 4.0 | P, S | 0.099 |
| 23-a | Invention sample | 27 | 6.9 | 4.2 | P, S | 0 | 0 | P, S | 0.100 |
| 23-b | Invention sample | 27 | 0 | 0 | P, S | 6.8 | 4.1 | P, S | 0.098 |
| 24 | Invention sample | 29 | 9.2 | 6.3 | P, S | 9.0 | 6.4 | P, S | 0.065 |

TABLE 3-continued

| No. | Classification | Thin strip thickness (μm) | Thicknesses of ultra-thin oxide layer and segregation layer: Surface not contacting cooling substrate (free-side surface): Ultra-thin oxide layer | Segregation layer | Kind of segregation layer | Surface contacting cooling substrate (roll-side surface): Ultra-thin oxide layer | Segregation layer | Kind of segregation layer | Core loss $W_{13/50}$ (W/kg) |
|---|---|---|---|---|---|---|---|---|---|
| 25 | Invention sample | 29 | 10.9 | 6.7 | P, S | 10.7 | 6.5 | P, S | 0.061 |
| 26 | Invention sample | 29 | 14.6 | 8.6 | P, S | 14.3 | 8.7 | P, S | 0.075 |
| 27 | Invention sample | 30 | 18.9 | 11.9 | P, S | 18.2 | 12.8 | P, S | 0.089 |
| 28 | Comparative sample | 29 | 23.2 | 13.2 | P, S | 22.9 | 13.8 | P, S | 0.121 |

Example 4

Amorphous thin strips having the same chemical composition as in Example 3 were cast in the normal atmosphere in the same manner as in Example 2. As a comparative example, one of the thin strips was cooled at such a cooling rate that a segregation layer did not form. Here, the thicknesses and the structures of the ultra-thin oxide layers were changed by changing the positions and the temperatures at which the thin strips peeled off the cooling roll during the casting. The thicknesses of the ultra-thin oxide layers were measured in the same manner as in Example 1, and the structures thereof were examined by observing the sectional surfaces of the ultra-thin oxide layers with TEM. The thin strips were annealed in the same manner as in Example 1 and the core losses thereof were measured also in the same manner as in Example 1. The results are shown in Table 4.

The thicknesses of the ultra-thin oxide layers tended to increase and the core losses to lower as the temperatures at which the thin strips peeled off the cooling roll rose. The comparative sample No. 29 having the ultra-thin oxide layers which thicknesses were less than 5 nm had the single layer and showed a high core loss. The invention samples Nos. 30 to 35 having the ultra-thin oxide layers which thicknesses were 5 nm or more and having the bilaminar structures showed low core losses. All of the second oxide laminas on the mother phase sides of the bilaminar ultra-thin oxide layers were composed of amorphous structures, and the first oxide laminas on the outer surface sides thereof changed from amorphous structures to crystalline structures as the thicknesses increased.

TABLE 4

| No. | Classification | Thin strip thickness (μm) | Ultra-thin oxide layer thickness: Surface not contacting cooling substrate (free-side surface): Ultra-thin oxide layer | First oxide lamina | Second oxide lamina | Surface contacting cooling substrate (roll-side surface): Ultra-thin oxide layer | First oxide lamina | Second oxide lamina | Core loss $W_{13/50}$ (W/kg) | Structure of ultra-thin oxide layer: Number of laminas | First oxide lamina | Second oxide lamina |
|---|---|---|---|---|---|---|---|---|---|---|---|---|
| 29 | Comparative sample | 25 | 3.8 | 3.8 | — | 3.7 | 3.7 | — | 0.132 | 1 | Amorphous structure | |
| 30 | Invention sample | 27 | 5.2 | 3.0 | 2.2 | 5.1 | 2.8 | 2.3 | 0.101 | 2 | | Amorphous structure |
| 31 | Invention sample | 26 | 7.0 | 4.4 | 2.6 | 6.9 | 4.2 | 2.7 | 0.098 | 2 | | |
| 32 | Invention sample | 28 | 9.4 | 5.3 | 4.1 | 9.2 | 5.0 | 4.2 | 0.067 | 2 | Crystalline structure | |
| 33 | Invention sample | 28 | 10.5 | 6.0 | 4.5 | 10.4 | 6.2 | 4.2 | 0.062 | 2 | | |
| 34 | Invention sample | 29 | 14.5 | 9.7 | 4.8 | 14.3 | 9.6 | 4.7 | 0.073 | 2 | | |
| 35 | Invention sample | 30 | 18.2 | 11.8 | 6.4 | 17.9 | 11.5 | 6.4 | 0.088 | 2 | | |

Example 5

Thin strips having the chemical composition of $Fe_{80.5}Si_{2.6}B_{15.1}P_{0.8}C_1$ (in atomic percentage), with one of As, Sb, Bi, S, Se and Te added thereto respectively, were cast in the normal atmosphere in the same manner as in Example 2. At the casting, the positions at which the thin strips peeled off the cooling roll were kept constant and the temperatures at the peel-off were controlled to roughly 180° C. It was confirmed that the mother phases contained P by 0.8 atomic %. The thicknesses and the structures of the ultra-thin oxide layers were examined in the same manner as in Example 4 and the core losses were measured also in the same manner as in Example 4. The results are shown in Table 5.

By adding one of the aforementioned elements, any of the samples could have bilaminar ultra-thin oxide layers and a low core loss.

TABLE 5

| | | | Ultra-thin oxide layer thickness | | | | | | | Structure of ultra-thin oxide layer | | |
|---|---|---|---|---|---|---|---|---|---|---|---|---|
| | | | Surface not contacting cooling substrate (free-side surface) | | | Surface contacting cooling substrate (roll-side surface) | | | | | | |
| No. | Classification | Element addition amount (mass %) | Ultra-thin oxide layer | First oxide lamina | Second oxide lamina | Ultra-thin oxide layer | First oxide lamina | Second oxide lamina | Core loss $W_{13/50}$ (W/kg) | Number of laminas | First oxide lamina | Second oxide lamina |
| 36 | Invention sample | As: 0.03 | 6.7 | 3.7 | 3.0 | 6.4 | 3.3 | 3.1 | 0.107 | 2 | Mixed layer | Amorphous structure |
| 37 | Invention sample | Sb: 0.03 | 7.8 | 4.4 | 3.4 | 7.6 | 4.1 | 3.5 | 0.098 | 2 | Crystalline structure | Amorphous structure |
| 38 | Invention sample | Bi: 0.03 | 8.1 | 4.5 | 3.6 | 8.0 | 4.2 | 3.8 | 0.089 | 2 | Crystalline structure | Amorphous structure |
| 39 | Invention sample | S: 0.03 | 9.1 | 5.0 | 4.1 | 9.0 | 5.1 | 3.9 | 0.087 | 2 | Crystalline structure | Amorphous structure |
| 40 | Invention sample | Se: 0.03 | 8.2 | 4.4 | 3.8 | 8.1 | 4.4 | 3.7 | 0.093 | 2 | Crystalline structure | Amorphous structure |
| 41 | Invention sample | Te: 0.03 | 8.4 | 4.2 | 4.2 | 8.2 | 4.3 | 3.9 | 0.097 | 2 | Crystalline structure | Amorphous structure |

Mixed layer: mixture of amorphous and crystalline structures

Example 6

Thin strips having the same chemical composition as in Example 3 and various thicknesses were cast in the normal atmosphere by using a multi-slot nozzle. The outer diameter of the cooling roll was 600 mm. Here, the thicknesses of the ultra-thin oxide layers were changed by changing the positions and the temperatures at which the thin strips peeled off the cooling roll during the casting. The thicknesses of the ultra-thin oxide layers were measured in the same manner as in Example 1. The thin strips were annealed in the same manner as in Example 1 and the core losses thereof were measured also in the same manner as in Example 1. The results are shown in Table 6.

The comparative sample No. 42 having the ultra-thin oxide layer which thickness was less than 5 nm and the comparative sample No. 50 having the ultra-thin oxide layer which thickness was more than 20 nm had high core losses. On the other hand, any of the invention samples Nos. 43 to 49 had a low core loss. Whereas the casting was difficult because of the forming of innumerable perforations in the case of the comparative sample No. 42 and the brittleness of the material in the case of the comparative sample No. 50, the casting operation was stable in any case of the invention samples.

TABLE 6

| No. | Classification | Thin strip thickness (μm) | Ultra-thin oxide layer thickness (nm) | Segregation layer thickness (nm) | Core loss $W_{13/50}$ (W/kg) |
|---|---|---|---|---|---|
| 42 | Comparative sample | 7.5 | 4.2 | — | 0.146 |
| 43 | Invention sample | 12 | 5.1 | 2.3 | 0.118 |
| 44 | Invention sample | 26 | 7.0 | 4.2 | 0.098 |

TABLE 6-continued

| No. | Classification | Thin strip thickness (μm) | Ultra-thin oxide layer thickness (nm) | Segregation layer thickness (nm) | Core loss $W_{13/50}$ (W/kg) |
|---|---|---|---|---|---|
| 45 | Invention sample | 38 | 8.5 | 5.4 | 0.105 |
| 46 | Invention sample | 46 | 9.2 | 3.9 | 0.115 |
| 47 | Invention sample | 50 | 9.5 | 3.2 | 0.118 |
| 48 | Invention sample | 75 | 14.8 | 3.8 | 0.119 |
| 49 | Invention sample | 96 | 19.8 | 4.3 | 0.120 |
| 50 | Comparative sample | 110 | 21.5 | 4.1 | 0.143 |

Example 7

Thin strips were cast through the single-roll process by using the alloys containing, in atomic percentage, 80.3% $Fe_{0.8}Co_{0.2}$, 2.5% Si, (16−Y)% B, Y% P, 1% C and 0.2% impurity elements such as Mn and S in total. The alloy compositions in this example were the ones wherein X in $Fe_{1-X}Co_X$ was 0.2 and a part of 16 atomic % B was replaced with Y atomic % P. Then, as shown in Table 7, the value of Y was adjusted to 0, 0.05, 13.5 and 16 for the comparative samples and 0.5, 1.2, 3.1, 6.4, 9.4 and 10.7 for the invention samples.

First, each of the alloys having respective prescribed chemical compositions was melted in a quartz crucible by high frequency induction heating, and then the molten metal was sprayed onto a copper-alloy cooling roll through a slot nozzle having a rectangular opening 0.4×25 mm in size and being fixed at the top of the crucible. The diameter of the cooling roll was 580 mm and the rotation speed thereof was 800 rpm. The thin strips about 27 μm in thickness and 25 mm in width were obtained through the casting.

The cast thin strips were cut to a length of 120 mm and then annealed at the temperatures of 320° C., 340° C., 360° C., 380° C. and 400° C. for 1 h. in a nitrogen atmosphere while a magnetic field was applied. After that, the alternating current magnetic properties of the thin strips were evaluated by using an SST (a single strip tester).

The evaluation items were the maximum magnetic flux density $B_{80}$ measured when a maximum impressed magnetic field was 80 A/m and the core loss measured when a maximum magnetic flux density was 1.3 T. The frequency at the time of the measurement was 50 Hz. The results are shown in Tables 8 and 9.

It was clearly understood from Table 8 that, in any case of the invention samples NOS. 3 to 8, when the annealing temperatures were in the range from 320° C. to 400° C., the magnetic flux densities $B_{80}$ were as high as 1.37 T or more, the standard deviation of $B_{80}$ was as small as less than 0.1, and thus the excellent soft magnetic properties were obtained. Therefore, it was also understood that any of the invention samples Nos. 3 to 8 had such an excellent annealing temperature property that the maximum annealing temperature $T_A$max for securing the above excellent soft magnetic properties was 400° C. or higher and the minimum annealing temperature $T_A$min for the same was 320° C. or lower, namely, the value of $\Delta T_A$ defined as $\Delta T_A = T_A\text{max} - T_A\text{min}$ was at least 80° C.

In the case of the comparative sample No. 2, the value of $B_{80}$ was less than 1.37 T at an annealing temperature of 420° C. in an additional test and the required criterion $\Delta T_A \geqq 80°$ C. was not satisfied.

In any case of the invention samples Nos. 4 to 8 wherein the P contents were in the range from 1 to 12 atomic %, the standard deviation of $B_{80}$ was 0.07 or less and therefore it was clear that the thin strip having the further suppressed fluctuation of the magnetic flux densities was obtained.

Further, in any case of the invention samples Nos. 5 to 8 wherein the B contents were in the range from more than 5 to less than 14 atomic %, the standard deviation of $B_{80}$ was 0.05 or less and therefore it was clear that the thin strip having the still further suppressed fluctuation of the magnetic flux densities was obtained.

It was understood from Table 9 that, in any case of the samples Nos. 3 to 8 having the chemical compositions in the range specified in the present invention, the core losses as low as 0.12 W/kg or less were obtained when the annealing temperatures were in the range from 320° C. to 380° C. Therefore, it was also understood that any of the invention samples Nos. 3 to 8 had such an excellent annealing temperature property that the maximum annealing temperature $T_B$max for securing the above low core losses was 380° C. or higher and the minimum annealing temperature $T_B$min for the same was 320° C. or lower, namely, the value of $\Delta T_b$ defined as $\Delta T_B = T_B\text{max} - T_B\text{min}$ was at least 60° C.

Though the comparative sample No. 9 showed as good a core loss property as the above, the magnetic flux densities $B_{80}$ thereof were lower than the level of the present invention as seen in Table 8. The comparative sample No. 10 could not be excited up to a magnetic flux density of 1.3 T after the annealing at 400° C.

TABLE 7

| No. | Classification | Substituted P content (Y) | B content (16 − Y) |
|---|---|---|---|
| 1 | Comparative sample | 0 | 16 |
| 2 | Comparative sample | 0.05 | 15.95 |
| 3 | Invention sample | 0.5 | 15.5 |
| 4 | Invention sample | 1.2 | 14.8 |
| 5 | Invention sample | 3.1 | 12.9 |
| 6 | Invention sample | 6.4 | 9.6 |
| 7 | Invention sample | 9.4 | 6.6 |
| 8 | Invention sample | 10.7 | 5.3 |
| 9 | Comparative sample | 13.5 | 2.5 |
| 10 | Comparative sample | 16 | 0 |

TABLE 8

Measurement results of $B_{80}$ (unit: T)

| No. | Classification | Annealing temperature 320° C. | 340° C. | 360° C. | 380° C. | 400° C. | Standard deviation |
|---|---|---|---|---|---|---|---|
| 1 | Comparative sample | 1.34 | 1.48 | 1.58 | 1.57 | 1.35 | 0.103 |
| 2 | Comparative sample | 1.21 | 1.44 | 1.57 | 1.56 | 1.53 | 0.134 |
| 3 | Invention sample | 1.37 | 1.45 | 1.56 | 1.57 | 1.51 | 0.074 |
| 4 | Invention sample | 1.39 | 1.48 | 1.55 | 1.54 | 1.49 | 0.057 |

TABLE 8-continued

| | | Measurement results of $B_{80}$ (unit: T) | | | | | |
|---|---|---|---|---|---|---|---|
| | | Annealing temperature | | | | | Standard |
| No. | Classification | 320° C. | 340° C. | 360° C. | 380° C. | 400° C. | deviation |
| 5 | Invention sample | 1.43 | 1.51 | 1.56 | 1.53 | 1.52 | 0.043 |
| 6 | Invention sample | 1.42 | 1.48 | 1.50 | 1.49 | 1.50 | 0.030 |
| 7 | Invention sample | 1.40 | 1.45 | 1.46 | 1.45 | 1.44 | 0.021 |
| 8 | Invention sample | 1.37 | 1.45 | 1.46 | 1.45 | 1.42 | 0.033 |
| 9 | Comparative sample | 1.33 | 1.36 | 1.38 | 1.36 | 1.29 | 0.031 |
| 10 | Comparative sample | 1.29 | 1.32 | 1.33 | 1.24 | 0.12 | 0.471 |

TABLE 9

| | | Measurement results of core loss (unit: W/kg) | | | | |
|---|---|---|---|---|---|---|
| | | Annealing temperature | | | | |
| No. | Classification | 320° C. | 340° C. | 360° C. | 380° C. | 400° C. |
| 1 | Comparative sample | 0.142 | 0.133 | 0.131 | 0.161 | 0.301 |
| 2 | Comparative sample | 0.149 | 0.121 | 0.080 | 0.087 | 0.195 |
| 3 | Invention sample | 0.119 | 0.109 | 0.079 | 0.105 | 0.185 |
| 4 | Invention sample | 0.117 | 0.095 | 0.072 | 0.108 | 0.180 |
| 5 | Invention sample | 0.111 | 0.086 | 0.067 | 0.069 | 0.145 |
| 6 | Invention sample | 0.104 | 0.078 | 0.066 | 0.064 | 0.087 |
| 7 | Invention sample | 0.095 | 0.073 | 0.065 | 0.064 | 0.069 |
| 8 | Invention sample | 0.105 | 0.088 | 0.080 | 0.079 | 0.082 |
| 9 | Comparative sample | 0.106 | 0.099 | 0.088 | 0.086 | 0.125 |
| 10 | Comparative sample | 0.112 | 0.098 | 0.082 | 0.221 | Un-measurable |

Example 8

Thin strips were cast in the same manner as in Example 7 by using the alloys containing, in atomic percentage, 80.3% $Fe_{8.0}Co_{0.2}$, Z% Si, (15.2−Z)% B, 3.3% P, 1% C and 0.2% impurity elements such as Mn and S in total. The alloy compositions in this example were the ones wherein a part of 15.2 atomic % B was replaced with Z atomic % Si. Then, as shown in Table 10, the value of Z was adjusted to 1.8, 4.4 and 5.6 for the comparative samples and 2.3, 3.0, 3.5 and 3.9 for the invention samples.

The magnetic properties of the thin strips were evaluated in the same manner as in Example 7. The results are shown in Tables 11 and 12.

It was clearly understood from Table 11 that, in any case of the invention samples Nos. 12 to 15, when the annealing temperatures were in the range from 320° C. to 400° C., the magnetic flux densities $B_{80}$ were as high as 1.37 T or more, the standard deviation of $B_{80}$ was as small as less than 0.1, and thus the excellent soft magnetic properties were obtained. Therefore, it was also understood that any of the invention samples Nos. 12 to 15 had such an excellent annealing temperature property that the maximum annealing temperature $T_A$max for securing the above excellent soft magnetic properties was 400° C. or higher and the minimum annealing temperature $T_A$min for the same was 320° C. or lower, namely, the value of $\Delta T_A$ defined as $\Delta T_A = T_A\text{max} - T_A\text{min}$ was at least 80° C.

In the cases of the comparative samples Nos. 11 and 17, the standard deviations of $B_{80}$ were not less than 0.1 and, in the cases of the comparative samples Nos. 11, 16 and 17, the values of $B_{80}$ were less than 1.37 T at an annealing temperature of 420° C. in additional tests and the required criterion $\Delta T_A \geqq 80°$ C. was not satisfied.

It was understood from Table 12 that, in any case of the samples Nos. 12 to 15 having the chemical compositions in the range specified in the present invention, the core losses as low as 0.12 W/kg or less were obtained when the annealing temperatures were in the range from 320° C. to 380° C. Therefore, it was also understood that any of the invention samples Nos. 12 to 15 had such an excellent annealing temperature property that the maximum annealing temperature $T_B$max for securing the above low core losses was 380° C. or higher and the minimum annealing temperature $T_B$min for the same was 320° C. or lower, namely, the value of $\Delta T_B$ defined as $\Delta T_B = T_B\text{max} - T_B\text{min}$ was at least 60° C.

Though the comparative sample No. 11 showed as good a core loss property as the above, the magnetic flux densities $B_{80}$ thereof were lower than the level of the present invention as seen in Table 11.

It was understood from this example that the effects of P addition in the present invention did not show up when an Si content was 4 atomic % or more.

TABLE 10

| No. | Classification | Si content (Z) | B content (15.2 − Z) |
|---|---|---|---|
| 11 | Comparative sample | 1.8 | 13.4 |
| 12 | Invention sample | 2.3 | 12.9 |
| 13 | Invention sample | 3.0 | 12.2 |
| 14 | Invention sample | 3.5 | 11.7 |
| 15 | Invention sample | 3.9 | 11.3 |
| 16 | Comparative sample | 4.4 | 10.8 |
| 17 | Comparative sample | 5.6 | 9.6 |

TABLE 11

Measurement results of $B_{80}$ (unit: T)

| No. | Classification | Annealing temperature 320° C. | 340° C. | 360° C. | 380° C. | 400° C. | Standard deviation |
|---|---|---|---|---|---|---|---|
| 11 | Comparative sample | 1.23 | 1.44 | 1.50 | 1.49 | 1.48 | 0.101 |
| 12 | Invention sample | 1.44 | 1.53 | 1.51 | 1.51 | 1.52 | 0.032 |
| 13 | Invention sample | 1.43 | 1.54 | 1.53 | 1.52 | 1.53 | 0.040 |
| 14 | Invention sample | 1.42 | 1.52 | 1.52 | 1.53 | 1.50 | 0.040 |
| 15 | Invention sample | 1.40 | 1.51 | 1.52 | 1.52 | 1.50 | 0.046 |
| 16 | Comparative sample | 1.30 | 1.44 | 1.47 | 1.50 | 1.48 | 0.072 |
| 17 | Comparative sample | 1.22 | 1.49 | 1.50 | 1.52 | 1.47 | 0.111 |

TABLE 12

Measurement results of core loss (unit: W/kg)

| No. | Classification | Annealing temperature 320° C. | 340° C. | 360° C. | 380° C. | 400° C. |
|---|---|---|---|---|---|---|
| 11 | Comparative sample | 0.113 | 0.107 | 0.101 | 0.109 | 0.140 |
| 12 | Invention sample | 0.110 | 0.087 | 0.069 | 0.070 | 0.139 |
| 13 | Invention sample | 0.105 | 0.089 | 0.078 | 0.079 | 0.138 |
| 14 | Invention sample | 0.112 | 0.090 | 0.082 | 0.085 | 0.139 |
| 15 | Invention sample | 0.110 | 0.089 | 0.082 | 0.089 | 0.130 |
| 16 | Comparative sample | 0.126 | 0.093 | 0.088 | 0.092 | 0.179 |
| 17 | Comparative sample | 0.135 | 0.096 | 0.074 | 0.089 | 0.188 |

Example 9

Thin strips were cast in the same manner as in Example 7 by using the alloys containing, in atomic percentage, 2.5% Si, 3.3% P and 0.2% impurity elements such as Mn and S in total with the contents of $Fe_{0.9}Co_{0.1}$, B and C varied as shown in Table 13.

The magnetic properties of the thin strips were evaluated in the same manner as in Example 7. The annealing temperatures were in the range from 280° C. to 400° C. The results are shown in Tables 14 and 15. The standard deviations in Table 14 were calculated from the values of $B_{80}$ in the area surrounded by the bold lines, respectively.

It was clearly understood from Table 14 that, in any of the invention samples: Nos. 19 and 20, when the annealing temperatures were in the range from 280° C. to 360° C.; No. 21, when the annealing temperatures were in the range from 300° C. to 380° C.; and Nos. 22 to 24, when the annealing temperatures were in the range from 320° C. to 400° C., the magnetic flux densities $B_{80}$ were as high as 1.37 T or more, the standard deviation of $B_{80}$ was as small as less than 0.1, and thus the excellent soft magnetic properties were obtained.

Therefore, it was understood that any of the above thin strips had such an excellent annealing temperature property that the value of the $\Delta T_A$ defined as $\Delta T_A = T_A max - T_A min$ was at least 80° C.

In the cases of the invention samples Nos. 21 and 22, the contents of $Fe_{0.9}Co_{0.1}$ were in the range from more than 80 to 82 atomic %, the $T_A min$ was 280° C. or lower, and therefore the annealing temperature range $\Delta T_A$ was further expanded.

In the case of the comparative sample No. 25, the value of $B_{80}$ was less than 1.37 T at an annealing temperature of 420° C. in an additional test and the required criterion $\Delta T_A \geqq 80°$ C. was not satisfied. In the case of the comparative sample No. 26, the required criterion $\Delta T_A \geqq 80°$ C. was not satisfied. In the case of the comparative sample No. 18, the content of $Fe_{0.9}Co_{0.1}$ exceeded 86 atomic %, an amorphous structure was not obtained, and therefore the value of $B_{80}$ was less than 1 T.

It was also understood from Table 15 that, in any of the cases of the invention samples Nos. 19 to 24 and the comparative samples Nos. 25 and 26, the core losses as low as 0.12 W/kg or less could be obtained in such a wide annealing temperature range that the value of $\Delta T_B$ defined as $T_B max - T_B min$ was 60° C. or more; this phenomena had not been seen in the prior art. Here, the samples Nos. 25 and 26 were classified as comparative samples because they did not satisfy the required criterion $\Delta T_A \geqq 80°$ C.

TABLE 13

| No. | Classification | $Fe_{0.9}Co_{0.1}$ (at %) | B (at %) | C (at %) |
|---|---|---|---|---|
| 18 | Comparative sample | 87.0 | 6.8 | 0.2 |
| 19 | Invention sample | 84.9 | 8.8 | 0.3 |
| 20 | Invention sample | 83.6 | 10.0 | 0.4 |
| 21 | Invention sample | 81.3 | 12.0 | 0.7 |
| 22 | Invention sample | 80.1 | 12.8 | 1.1 |
| 23 | Invention sample | 79.7 | 12.9 | 1.4 |
| 24 | Invention sample | 78.4 | 13.6 | 2.0 |
| 25 | Comparative sample | 77.1 | 15.2 | 1.7 |
| 26 | Comparative sample | 76.0 | 17.5 | 0.5 |

TABLE 14

Measurement results of $B_{80}$ (unit: T)

| No. | Classification | Annealing temperature | | | | | | | Standard deviation |
|---|---|---|---|---|---|---|---|---|---|
| | | 280° C. | 300° C. | 320° C. | 340° C. | 360° C. | 380° C. | 400° C. | |
| 18 | Comparative sample | 0.77 | 0.89 | 0.98 | 0.99 | 0.98 | 0.21 | 0.13 | 0.084 |
| 19 | Invention sample | 1.37 | 1.41 | 1.49 | 1.53 | 1.53 | 0.28 | 0.16 | 0.065 |
| 20 | Invention sample | 1.41 | 1.40 | 1.48 | 1.51 | 1.50 | 0.35 | 0.15 | 0.046 |
| 21 | Invention sample | 1.39 | 1.42 | 1.45 | 1.51 | 1.51 | 1.49 | 1.39 | 0.036 |
| 22 | Invention sample | 1.39 | 1.41 | 1.44 | 1.50 | 1.52 | 1.54 | 1.52 | 0.034 |
| 23 | Invention sample | 1.35 | 1.39 | 1.44 | 1.50 | 1.52 | 1.49 | 1.47 | 0.027 |
| 24 | Invention sample | 1.30 | 1.37 | 1.39 | 1.40 | 1.44 | 1.47 | 1.44 | 0.029 |
| 25 | Comparative sample | 1.13 | 1.18 | 1.34 | 1.35 | 1.39 | 1.40 | 1.40 | 0.026 |
| 26 | Comparative sample | 1.09 | 1.15 | 1.30 | 1.29 | 1.30 | 1.32 | 1.28 | 0.013 |

TABLE 15

Measurement results of core loss (unit: W/kg)

| No. | Classification | Annealing temperature | | | | | | |
|---|---|---|---|---|---|---|---|---|
| | | 280° C. | 300° C. | 320° C. | 340° C. | 360° C. | 380° C. | 400° C. |
| 18 | Comparative sample | 0.448 | 0.475 | 0.513 | 0.770 | 1.311 | 5.125 | 7.143 |
| 19 | Invention sample | 0.120 | 0.117 | 0.111 | 0.117 | 0.352 | 4.156 | 6.285 |
| 20 | Invention sample | 0.117 | 0.109 | 0.088 | 0.079 | 0.238 | 3.125 | 5.198 |
| 21 | Invention sample | 0.124 | 0.113 | 0.104 | 0.079 | 0.112 | 0.118 | 0.201 |
| 22 | Invention sample | 0.129 | 0.116 | 0.107 | 0.086 | 0.069 | 0.071 | 0.144 |
| 23 | Invention sample | 0.137 | 0.115 | 0.098 | 0.084 | 0.069 | 0.072 | 0.138 |
| 24 | Invention sample | 0.133 | 0.117 | 0.101 | 0.082 | 0.074 | 0.072 | 0.129 |
| 25 | Comparative sample | 0.139 | 0.113 | 0.097 | 0.088 | 0.076 | 0.084 | 0.124 |
| 26 | Comparative sample | 0.136 | 0.112 | 0.114 | 0.098 | 0.101 | 0.103 | 0.129 |

Example 10

The alloys containing, in atomic percentage, 80.1% $Fe_{1-X}Co_X$, 2.5% Si, 12.4% B, 3.8% P, 1% C and 0.2% impurity elements such as Mn and S in total were prepared. Here, the value of X was adjusted to 0.02 and 0.47 for the comparative samples and 0.1, 0.18, 0.26 and 0.38 for the invention samples. Thin strips were cast in the same manner as in Example 7 by using these alloys, annealed at an annealing temperature of 320° C. in the same manner as in Example 1, and evaluated in the same manner as in Example 7.

The results are shown in Table 16. As seen in the table, in the cases of the invention samples Nos. 28 to 31, the values of $B_{80}$ were 1.37 T or more, the core losses were 0.12 W/kg or less, and therefore they showed excellent properties. In the cases of the comparative samples Nos. 27 and 32, the contents of $Fe_{1-X}Co_X$ were outside the range specified in the present invention and therefore the values of $B_{80}$ were less than 1.37 T.

TABLE 16

| No. | Classification | X | $B_{80}$ (T) | Core loss (W/kg) |
|---|---|---|---|---|
| 27 | Comparative sample | 0.02 | 1.36 | 0.109 |
| 28 | Invention sample | 0.1 | 1.43 | 0.107 |
| 29 | Invention sample | 0.18 | 1.51 | 0.108 |
| 30 | Invention sample | 0.26 | 1.53 | 0.100 |
| 31 | Invention sample | 0.38 | 1.55 | 0.111 |

TABLE 16-continued

| No. | Classification | X | $B_{80}$ (T) | Core loss (W/kg) |
|---|---|---|---|---|
| 32 | Comparative sample | 0.47 | 1.35 | 0.112 |

Example 11

Amorphous thin strips 50 mm in width were cast by using the alloys used for the invention sample No. 6 in Table 7 and the comparative sample No. 17 in Table 10. The casting process was the same as in Example 7 except that a slot nozzle having a rectangular opening 0.4×50 mm in size was used. The thickness of the thin strips thus obtained was 26 μm. Then, the thin strips were wound into toroidal iron cores having a coil thickness of about 50 mm.

The would iron cores were annealed by heating them at various heating rates from the room temperature to 400° C., retaining them at the temperature for 2 h., and then cooling them in a furnace. During the annealing treatment, a magnetic field was applied in the circumferential direction of an iron core, the temperature was controlled by controlling the atmospheric temperature, and the actual temperature of an iron core was measured with thermocouples in contact with different positions of the iron core.

As a result, it was found that, as a heating rate increased, the temperature difference between a furnace atmosphere and an iron core increased and also the temperature difference among the positions of the iron core increased. It was noted that the temperature of an iron core was equal to or lower than an atmospheric temperature in the furnace.

The value of $B_{80}$ was measured after primary and secondary coils were wound around an annealed iron core. As a result, it was confirmed that, in any of the iron cores produced from the alloy used for the invention sample No. 6, the value of $B_{80}$ was as high as 1.45 T even when the temperature difference among various portions increased up to the range from 80° C. to 100° C. It was also confirmed, on the other hand, that in any of the iron cores produced from the alloy used for the comparative sample No. 17, the value of $B_{80}$ was as low as 1.33 T when the temperature difference among various portions increased up to the range from 80° C. to 100° C.

Example 12

Thin strips were cast through the single-roll process by using the alloys containing, in atomic percentage, 80.5% $Fe_{0.93}Ni_{0.07}$, 2.4% Si, (15.9−Y)% B, Y% P, 1% C and 0.2% impurity elements such as Mn and S in total. The alloy compositions in this example were the ones wherein X in $Fe_{1-X}Co_X$ was 0.07 and a part of 15.9 atomic % B was replaced with Y atomic % P. Then, as shown in Table 17, the value of Y was adjusted to 0, 0.05, 13.2 and 15.9 for the comparative samples and 0.6, 1.3, 3.3, 6.3, 9.3 and 10.5 for the invention samples.

First, each of the alloys having respective prescribed chemical compositions was melted in a quartz crucible by high frequency induction heating, and then the molten metal was sprayed onto a copper-alloy cooling roll through a slot nozzle having a rectangular opening 0.4×25 mm in size and being fixed at the top of the crucible. The diameter of the cooling roll was 580 mm and the rotation speed thereof was 800 rpm. Thin strips about 26 μm in thickness and 25 mm in width were obtained through the casting.

The cast thin strips were cut to a length of 120 mm and then annealed at temperatures of 320° C., 340° C., 360° C., 380° C. and 400° C. for 1 h. in a nitrogen atmosphere while a magnetic field was applied. After that, the alternating current magnetic properties of the thin strips were evaluated by using an SST (a single strip tester).

The evaluation items were the maximum magnetic flux density $B_{80}$ measured when a maximum impressed magnetic field was 80 A/m and the core loss measured when a maximum magnetic flux density was 1.3 T. The frequency at the time of the measurement was 50 Hz. The results are shown in Tables 17 and 18.

It was clearly understood from Table 17 that, in any case of the invention samples Nos. 3 to 8, when the annealing temperatures were in the range from 320° C. to 400° C., the magnetic flux densities $B_{80}$ were as high as 1.35 T or more, the standard deviation of $B_{80}$ was as small as less than 0.1, and thus the excellent soft magnetic properties were obtained. Therefore, it was also understood that any of the invention samples Nos. 3 to 8 had such an excellent annealing temperature property that the maximum annealing temperature $T_A$max for securing the above excellent soft magnetic properties was 400° C. or higher and the minimum annealing temperature $T_A$min for the same was 320° C. or lower, namely, the value of $\Delta T_A$ defined as $\Delta T_A = T_A\text{max} - T_A\text{min}$ was at least 80° C.

In the case of the comparative sample No. 2, the value of $B_{80}$ was less than 1.35 T at an annealing temperature of 420° C. in an additional test and the required criterion $\Delta T_A \geqq 80°$ C. was not satisfied.

In any of the invention samples Nos. 4 to 8 wherein the P contents were in the range from 1 to 12 atomic %, the standard deviation of $B_{80}$ was 0.07 or less and therefore it was clear that the thin strip having the further suppressed fluctuation of the magnetic flux densities was obtained.

Further, in any of the invention samples Nos. 5 to 8 wherein the B contents were in the range from more than 5 to less than 14 atomic %, the standard deviation of $B_{80}$ was 0.05 or less and therefore it was clear that the thin strip having the still further suppressed fluctuation of the magnetic flux densities was obtained.

It was understood from Table 18 that, in any case of the samples Nos. 3 to 8 having the chemical compositions in the range specified in the present invention, core losses as low as 0.12 W/kg or less were obtained when the annealing temperatures were in the range from 320° C. to 380° C. Therefore, it was also understood that any of the invention samples Nos. 3 to 8 had such an excellent annealing temperature property that the maximum annealing temperature $T_B$max for securing the above low core losses was 380° C. or higher and the minimum annealing temperature $T_B$min for the same was 320° C. or lower, namely, the value of $\Delta T_B$ defined as $\Delta T_B = T_B\text{max} - T_B\text{min}$ was at least 60° C.

Though the comparative sample No. 9 showed as good a core loss property as the above, the magnetic flux densities $B_{80}$ thereof were lower than the level of the present invention as seen in Table 17. The comparative sample No. 10 could not be excited up to a magnetic flux density of 1.3 T after the annealing at 400° C.

TABLE 17

| | | Measurement results of $B_{80}$ (unit: T) | | | | | | | |
|---|---|---|---|---|---|---|---|---|---|
| | | Substituted P | B content | Annealing temperature | | | | | Standard |
| No. | Classification | content Y | 15.9 − Y | 320° C. | 340° C. | 360° C. | 380° C. | 400° C. | deviation |
| 1 | Comparative sample | 0 | 15.9 | 1.32 | 1.47 | 1.55 | 1.56 | 1.33 | 0.104 |
| 2 | Comparative sample | 0.05 | 15.85 | 1.17 | 1.42 | 1.54 | 1.54 | 1.53 | 0.142 |
| 3 | Invention sample | 0.6 | 15.3 | 1.35 | 1.43 | 1.53 | 1.54 | 1.50 | 0.071 |
| 4 | Invention sample | 1.3 | 14.6 | 1.36 | 1.46 | 1.53 | 1.53 | 1.48 | 0.062 |
| 5 | Invention sample | 3.3 | 12.6 | 1.40 | 1.49 | 1.51 | 1.52 | 1.50 | 0.043 |
| 6 | Invention sample | 6.3 | 9.6 | 1.40 | 1.46 | 1.48 | 1.48 | 1.48 | 0.031 |
| 7 | Invention sample | 9.3 | 6.6 | 1.38 | 1.42 | 1.43 | 1.44 | 1.42 | 0.020 |
| 8 | Invention sample | 10.5 | 5.4 | 1.35 | 1.41 | 1.42 | 1.43 | 1.41 | 0.028 |
| 9 | Comparative sample | 13.2 | 2.7 | 1.31 | 1.35 | 1.36 | 1.34 | 1.27 | 0.033 |
| 10 | Comparative sample | 15.9 | 0 | 1.30 | 1.31 | 1.32 | 1.21 | 0.11 | 0.472 |

TABLE 18

| | | Measurement results of core loss (unit: W/kg) | | | | | | |
|---|---|---|---|---|---|---|---|---|
| | | Substituted | B content | Annealing temperature | | | | |
| No. | Classification | P content Y | 15.9 − Y | 320° C. | 340° C. | 360° C. | 380° C. | 400° C. |
| 1 | Comparative sample | 0 | 15.9 | 0.146 | 0.134 | 0.133 | 0.163 | 0.273 |
| 2 | Comparative sample | 0.05 | 15.85 | 0.142 | 0.117 | 0.079 | 0.089 | 0.195 |
| 3 | Invention sample | 0.6 | 15.3 | 0.119 | 0.106 | 0.077 | 0.109 | 0.190 |
| 4 | Invention sample | 1.3 | 14.6 | 0.118 | 0.092 | 0.072 | 0.105 | 0.189 |
| 5 | Invention sample | 3.3 | 12.6 | 0.111 | 0.084 | 0.067 | 0.089 | 0.145 |
| 6 | Invention sample | 6.3 | 9.6 | 0.105 | 0.075 | 0.064 | 0.062 | 0.083 |
| 7 | Invention sample | 9.3 | 6.6 | 0.095 | 0.070 | 0.063 | 0.063 | 0.069 |
| 8 | Invention sample | 10.5 | 5.4 | 0.104 | 0.083 | 0.078 | 0.077 | 0.082 |
| 9 | Comparative sample | 13.2 | 2.7 | 0.106 | 0.089 | 0.084 | 0.082 | 0.122 |
| 10 | Comparative sample | 15.9 | 0 | 0.109 | 0.097 | 0.081 | 0.205 | Unmeasurable |

Example 13

Thin strips were cast in the same manner as in Example 12 by using the alloys containing, in atomic percentage, 80.4% $Fe_{0.9}Ni_{0.1}$, 2.6% Si, (16−Y)% B, Y% P, 0.8% C and 0.2% impurity elements such as Mn and S in total. In the alloy compositions in this example, as shown in Table 19, the value of Y was adjusted to 0, 0.05 and 13.8 for the comparative samples and 0.5, 1.3, 3.5, 5.8, 8.2, 9.6 and 11.7 for the invention samples.

The cast thin strips were cut and annealed at a temperature of 360° C. for 1 h. in a nitrogen atmosphere while a magnetic field was applied. Thereafter, the values of $\epsilon_f$ were measured by 180° bend tests, and the core losses by using an SST (a single strip tester). The results are shown in Table 19.

In any case of the invention samples Nos. 13 to 19, the value of $\epsilon_f$ was 0.015 or more and thus a remarkable brittleness improvement effect was obtained and the core loss was 0.12 W/kg or less and thus an excellent property was obtained. In the case of the comparative sample No. 11, though the value of $\epsilon_f$ was 0.015 or more, the core loss was poor. In the case of the comparative sample No. 20, the value of $\epsilon_f$ was less than 0.015 and therefore no brittleness improvement effect was obtained.

TABLE 19

| No. | Classification | Substituted P content Y | $\epsilon_f$ | Core loss (W/kg) |
|---|---|---|---|---|
| 11 | Comparative sample | 0 | 0.021 | 0.133 |

TABLE 19-continued

| No. | Classification | Substituted P content Y | $\epsilon_f$ | Core loss (W/kg) |
|---|---|---|---|---|
| 12 | Comparative sample | 0.05 | 0.020 | 0.124 |
| 13 | Invention sample | 0.5 | 0.019 | 0.088 |
| 14 | Invention sample | 1.3 | 0.019 | 0.082 |
| 15 | Invention sample | 3.5 | 0.018 | 0.083 |
| 16 | Invention sample | 5.8 | 0.016 | 0.080 |
| 17 | Invention sample | 8.2 | 0.017 | 0.086 |
| 18 | Invention sample | 9.6 | 0.016 | 0.092 |
| 19 | Invention sample | 11.7 | 0.015 | 0.092 |
| 20 | Comparative sample | 13.8 | 0.009 | 0.123 |

Example 14

Alloys containing, in atomic percentage, 80.4% $Fe_{1-X}Ni_X$, 2.6% Si, 12.4% B, 3.4% P, 1% C and 0.2% impurity elements such as Mn and S in total were prepared. Here, as shown in Table 20, the value of X was adjusted to 0 and 0.24 for the comparative samples and 0.05, 0.08, 0.14 and 0.18 for the invention samples. Thin strips were cast in the same manner as in Example 12 by using these alloys, annealed at an annealing temperature of 360° C. in the same manner as in Example 12, and evaluated by measuring the values of $\epsilon_f$ and the core losses in the same manner as in Example 13. The results are shown in Table 20.

As seen in Table 20, in the cases of the invention samples Nos. 22 to 25, the values of $\epsilon_f$ were 0.015 or more, the core losses were 0.12 W/kg or less, and therefore they showed excellent properties. In the case of the comparative sample No. 21 wherein the value of X was less than 0.05, the value of $\epsilon_f$ was less than 0.015. In the case of the comparative sample No. 26 wherein the value of X was more than 0.2, no better improvement effects than in the invention samples were obtained.

TABLE 20

| No. | Classification | Substituted Ni content X | $\epsilon_f$ | Core loss (W/kg) |
|---|---|---|---|---|
| 21 | Comparative sample | 0 | 0.010 | 0.070 |
| 22 | Invention sample | 0.05 | 0.016 | 0.072 |
| 23 | Invention sample | 0.08 | 0.017 | 0.068 |
| 24 | Invention sample | 0.14 | 0.019 | 0.080 |
| 25 | Invention sample | 0.18 | 0.021 | 0.082 |
| 26 | Comparative sample | 0.2 | 0.020 | 0.088 |

Example 15

Thin strips were cast in the same manner as in Example 12 by using the alloys containing, in atomic percentage, 80.6% $Fe_{0.85}Ni_{0.15}$, Z% Si, (15.1−Z)% B, 3.3% P, 0.8% C and 0.2% impurity elements such as Mn and S in total. The alloy compositions in this example were the ones wherein a part of 15.1 atomic % B was replaced with Z atomic % P. Then, as shown in Table 21, the value of Z was adjusted to 1.8 and 4.3 for the comparative samples and 2.3, 2.8 and 3.5 for the invention samples.

The thin strips were annealed at an annealing temperature of 360° C. in the same manner as in Example 12 and evaluated by measuring the values of $\epsilon_f$ and the core losses in the same manner as in Example 13.

The results are shown in Table 21. In the cases of the invention samples Nos. 28 to 30, the values of $\epsilon_f$ were 0.015 or more, the core losses were 0.12 W/kg or less, and therefore they showed excellent properties. In the cases of the comparative samples Nos. 27 and 31, the values of $\epsilon_f$ were less than 0.015.

TABLE 21

| No. | Classification | Si content Z | B content 15.1 − Z | $\epsilon_f$ | Core loss (W/kg) |
|---|---|---|---|---|---|
| 27 | Comparative sample | 1.8 | 13.3 | 0.012 | 0.110 |
| 28 | Invention sample | 2.3 | 12.8 | 0.016 | 0.105 |
| 29 | Invention sample | 2.8 | 12.3 | 0.017 | 0.095 |
| 30 | Invention sample | 3.5 | 11.6 | 0.016 | 0.098 |
| 31 | Comparative sample | 4.3 | 10.8 | 0.014 | 0.106 |

Example 16

Thin strips were cast through the same process as in Example 12 by using the alloys containing, in atomic percentage, 2.4% Si, 3.3% P and 0.2% impurity elements such as Mn and S in total with the contents of $Fe_{0.9}Ni_{0.1}$, B and C varied.

The thin strips were annealed at an annealing temperature of 340° C. in the same manner as in Example 12 and evaluated by measuring the values of $\epsilon_f$ and the core losses in the same manner as in Example 13.

The results are shown in Table 22. In the cases of the invention samples Nos. 33 to 36, the values of $\epsilon_f$ were 0.015 or more, the core losses were 0.12 W/kg or less, and therefore they showed excellent properties. In the cases of the comparative samples Nos. 32 and 37, the values of $\epsilon_f$ were less than 0.015 and moreover, in the case of the comparative sample No. 32, the core loss was poor.

TABLE 22

| No. | Classification | $Fe_{0.9}Ni_{0.1}$ | B | C | $\epsilon_f$ | Core loss (W/kg) |
|---|---|---|---|---|---|---|
| 32 | Comparative sample | 87 | 6.9 | 0.2 | 0.004 | 0.778 |
| 33 | Invention sample | 83 | 10.7 | 0.4 | 0.016 | 0.117 |
| 34 | Invention sample | 81.7 | 11.6 | 0.8 | 0.017 | 0.092 |
| 35 | Invention sample | 80.4 | 12.2 | 1.5 | 0.016 | 0.089 |
| 36 | Invention sample | 79.4 | 12.7 | 2.0 | 0.018 | 0.085 |
| 37 | Comparative sample | 77.6 | 16 | 0.5 | 0.014 | 0.098 |

Example 17

Iron-base amorphous alloy thin strips having the chemical composition, in atomic percentage, of $Fe_{80.2}Si_{2.7}B_{16-x}P_xC_{0.9}$ (B+P=16%), wherein the value of X was varied, and containing 0.2 atomic % impurity elements such as Mn and S in total were cast through the single-roll process. In the single-roll process, the molten metal of each of the alloys was sprayed onto a copper-alloy cooling roll through a slot nozzle having a rectangular opening 0.4×75 mm in size and being fixed at the top of a crucible. The diameter of the cooling roll was 580 mm and the rotation speed thereof was 800 rpm. Thin strips about 25 μm in thickness and 75 mm in width were obtained through the casting.

The cast thin strips were cut to a length of 120 mm, slit along the longitudinal direction into 3 strips 25 mm each in width, and then annealed at a temperature of 320° C. for 2 h. in a nitrogen atmosphere while a magnetic field was applied. After that, the core losses were measured under a maximum magnetic flux density of 1.3 T and a frequency of 50 Hz by using an SST (a single strip tester), the maximum and minimum core losses Wmax and Wmin were identified, and the values of (Wmax−Wmin)/Wmin were calculated. The results are shown in Table 23.

In the cases of the comparative samples Nos. 1 and 2 having small addition amounts of P, the values of Wmax re high, the values of (Wmax−Wmin)/Wmin exceeded 0.4, and thus high-performance transformers were not obtained. In the case of the comparative sample No. 9 having an excessive addition amount of P, the B content was less than 2 atomic %, and, as a result, there were portions where the amorphous structures were unstable and the core losses were poor.

In the cases of the invention samples Nos. 3 to 8, the values of Wmax were 0.12 W/kg or less, the values of (Wmax−Wmin)/Wmin were 0.4 or less, and thus high-performance transformers were obtained.

TABLE 23

| No. | Classification | P content X (at. %) | B content 16 − X (at. %) | Wmax (W/kg) | Wmin (W/kg) | (Wmax− Wmin)/Wmin |
|---|---|---|---|---|---|---|
| 1 | Comparative sample | 0 | 16 | 0.185 | 0.123 | 0.504 |
| 2 | Comparative sample | 0.18 | 15.82 | 0.146 | 0.103 | 0.417 |
| 3 | Invention sample | 1.1 | 14.9 | 0.120 | 0.090 | 0.333 |
| 4 | Invention sample | 1.4 | 14.6 | 0.108 | 0.084 | 0.286 |
| 5 | Invention sample | 3.2 | 12.8 | 0.101 | 0.081 | 0.247 |
| 6 | Invention sample | 6.5 | 9.5 | 0.098 | 0.082 | 0.195 |
| 7 | Invention sample | 9.7 | 6.3 | 0.092 | 0.078 | 0.179 |
| 8 | Invention sample | 10.9 | 5.1 | 0.102 | 0.086 | 0.186 |
| 9 | Comparative sample | 14.7 | 1.3 | 0.161 | 0.113 | 0.425 |

Example 18

Iron-base amorphous alloy thin strips containing 0.2 atomic % impurity elements such as Mn and S in total with the contents of Fe, Si, B, P and C varied were cast through the single-roll process. In the single-roll process, the molten metal of each of the alloys was sprayed onto a copper-alloy cooling roll through a slot nozzle having a rectangular opening 0.4×125 mm in size and being fixed at the top of a crucible. The diameter of the cooling roll was 580 mm and the rotation speed thereof was 800 rpm. Thin strips about 25 μm in thickness and 125 mm in width were obtained through the casting.

The cast thin strips were cut to a length of 120 mm, slit along the longitudinal direction into 5 strips 25 mm each in width, and then annealed at a temperature of 320° C. for 2 h. in a nitrogen atmosphere while a magnetic field was applied. After that, the core losses were measured under a maximum magnetic flux density of 1.3 T and a frequency of 50 Hz by using an SST (a single strip tester), the maximum and minimum core losses Wmax and Wmin were identified, and the values of (Wmax−Wmin)/Wmin were calculated. The results are shown in Table 24.

In the cases of the invention samples Nos. 12 to 22 wherein the contents of Fe, Si, B, P, C and B+P were in the respective ranges specified in the present invention, the values of (Wmax−Wmin)/Wmin were 0.4 or less and thus thin strips having core loss properties excellent and uniform in the width direction were obtained. In contrast, in the cases of the comparative samples Nos. 23 and 24 wherein the contents of B+P were less than 12 atomic %, the values of (Wmax−Wmin)/Wmin exceeded 0.4 and thus the uniformity in core loss in the width direction was poor. In the cases of the comparative samples Nos. 10 and 11 wherein the contents of B+P exceeded 20 atomic %, no further improved uniformity in core loss was obtained and, what was worse, the magnetic flux densities deteriorated in spite of the fact that the contents of B+P increased.

TABLE 24

| No. | Classification | Fe content (at. %) | Si content (at. %) | B content (at. %) | P content (at. %) | C content (at. %) | B + P content (at. %) | Wmax (W/kg) | Wmin (W/kg) | Wmax− Wmin / Wmin |
|---|---|---|---|---|---|---|---|---|---|---|
| 10 | Comparative sample | 75.2 | 2.1 | 14.1 | 8.1 | 0.3 | 22.2 | 0.109 | 0.085 | 0.282 |
| 11 | Comparative sample | 75.1 | 2.2 | 9.0 | 12.9 | 0.6 | 21.9 | 0.113 | 0.088 | 0.284 |
| 12 | Invention sample | 78.1 | 2.2 | 13.3 | 5.9 | 0.3 | 19.2 | 0.097 | 0.082 | 0.183 |
| 13 | Invention sample | 78.2 | 2.1 | 10.0 | 9.3 | 0.2 | 19.3 | 0.098 | 0.083 | 0.181 |
| 14 | Invention sample | 78.5 | 2.0 | 8.0 | 11.0 | 0.3 | 19.0 | 0.112 | 0.092 | 0.217 |
| 15 | Invention sample | 80.2 | 2.9 | 12.7 | 3.0 | 1.0 | 15.7 | 0.102 | 0.082 | 0.244 |
| 16 | Invention sample | 80.4 | 2.4 | 10.3 | 5.8 | 0.9 | 16.1 | 0.099 | 0.083 | 0.193 |
| 17 | Invention sample | 80.6 | 2.6 | 7.2 | 8.5 | 0.9 | 15.7 | 0.096 | 0.081 | 0.185 |
| 18 | Invention sample | 80.6 | 2.8 | 5.1 | 10.2 | 1.1 | 15.3 | 0.101 | 0.085 | 0.188 |
| 19 | Invention sample | 80.5 | 2.7 | 3.7 | 12.0 | 0.9 | 15.7 | 0.116 | 0.093 | 0.247 |
| 20 | Invention sample | 81.7 | 3.8 | 10.1 | 3.1 | 1.1 | 13.2 | 0.109 | 0.086 | 0.267 |
| 21 | Invention sample | 82.6 | 3.3 | 6.8 | 5.9 | 1.2 | 12.7 | 0.105 | 0.082 | 0.280 |
| 22 | Invention sample | 82.8 | 2.7 | 4.1 | 8.9 | 1.3 | 13.0 | 0.115 | 0.085 | 0.353 |
| 23 | Comparative sample | 84.6 | 4.2 | 7.9 | 1.8 | 1.3 | 9.7 | 0.132 | 0.090 | 0.467 |
| 24 | Comparative sample | 84.3 | 3.5 | 3.2 | 7.0 | 1.8 | 10.2 | 0.128 | 0.090 | 0.422 |

Example 19

Iron-base amorphous alloy thin strips having the chemical composition, in atomic percentage, of $Fe_{80.4}Si_{2.4}B_{15.8-X}P_XC_{1.2}$ (B+P=15.8%), wherein the value of X was varied, and containing 0.2 atomic % impurity elements such as Mn and S in total were cast through the single-roll process. In the single-roll process, the molten metal of each of the alloys was sprayed onto a copper-alloy cooling roll through a slot nozzle having a rectangular opening 0.4×25 mm in size and being fixed at the top of a crucible. The diameter of the cooling roll was 580 mm and the rotation speed thereof was 800 rpm. Thin strips about 25 μm in thickness and 25 mm in width were obtained through the casting.

The occurrence of air pockets was observed over the entire length of each of the thin strips and the average density of coarse air pockets 500 μm or more in length or 50 μm or more in width was calculated. Further, the cast thin strips were cut to a length of 120 mm and then annealed at a temperature of 320° C. for 1 h. in a nitrogen atmosphere while a magnetic field was applied. After that, the core losses were measured under a maximum magnetic flux density of 1.3 T by using an SST (a single strip tester). The results are shown in Table 25.

In the cases of the comparative samples Nos. 1 and 2 having small addition amounts of P, the densities of the coarse air pockets were high, the core losses exceeded 0.12 W/kg, and thus excellent magnetic properties were not obtained. In the case of the comparative sample No. 9 having an excessive addition amount of P, though the density of the coarse air pockets was low, the amorphous structure was unstable because the B amount was less than 2 atomic %, and, as a result, the core loss was high and thus excellent magnetic properties were not obtained.

In the cases of the invention samples Nos. 3 to 8, the densities of the coarse air pockets were low, the core losses were 0.12 W/kg or less, and thus excellent magnetic properties were obtained. In any case of the invention samples, the percentage of the area in which the density of the coarse air pockets was 10/cm$^2$ or less was 80% or more. In contrast, the same percentage was less than 80% in any case of the comparative samples.

TABLE 25

| No. | Classification | P content X (at. %) | B content 15.8 − X (at. %) | Number of coarse air pockets (piece/cm$^2$) | Core loss W/kg |
|---|---|---|---|---|---|
| 1 | Comparative sample | 0 | 15.8 | 14 | 0.151 |
| 2 | Comparative sample | 0.17 | 15.63 | 12 | 0.132 |
| 3 | Invention sample | 1.2 | 14.6 | 8 | 0.12 |
| 4 | Invention sample | 1.8 | 14 | 6 | 0.118 |
| 5 | Invention sample | 3.5 | 12.3 | 2 | 0.111 |
| 6 | Invention sample | 6.8 | 9.0 | 1 | 0.102 |
| 7 | Invention sample | 9.5 | 6.3 | 2 | 0.098 |
| 8 | Invention sample | 11.2 | 4.6 | 3 | 0.101 |
| 9 | Comparative sample | 14.8 | 1.0 | 2 | 0.128 |

Example 20

Iron-base amorphous alloy thin strips having the chemical composition, in atomic percentage, of $Fe_{80.6}Si_{2.6}B_{15.9-X}P_XC_{0.7}$ (B+P=15.9%), wherein the value of X was varied, and containing 0.2 atomic % impurity elements such as Mn and S in total were cast through the single-roll process. In the single-roll process, the molten metal of each of the alloys was sprayed onto a copper-alloy cooling roll through a slot nozzle having a rectangular opening 0.6×140 mm in size and being fixed at the top of a crucible. The diameter of the cooling roll was 580 mm and the rotation speed thereof was 800 rpm. The target thickness of the thin strips at the casting was 25 μm and the target width thereof 140 mm.

The thickness deviation in the width direction Δt was measured over the entire length of each of the thin strips. Further, the cast thin strips were cut to a length of 120 mm and then annealed at a temperature of 320° C. for 2 h. in a nitrogen atmosphere while a magnetic field was applied. After that, the core losses were measured under a maximum magnetic flux density of 1.3 T and a frequency of 50 Hz by using an SST (a single strip tester). The results are shown in Table 26. The thickness of each of the thin strips was obtained by measuring the weight of a cut sheet 20 mm in width and 100 mm in length in the casting direction and converting the weight by using the density of the material. A packing factor was obtained by winding a strip around a bobbin 100 mm in outer diameter up to an apparent thickness of 50 mm and calculating from the weight and the apparent volume of the wound strip.

In cases of the comparative samples Nos. 10 and 11 having small addition amounts of P, the thickness deviations Δt exceeded 5 μm, the packing factors were low, the core losses exceeded 0.12 W/kg, and thus excellent magnetic properties were not obtained. In the case of the comparative sample No. 18 having an excessive addition amount of P, though the thickness deviation Δt was small, the amorphous structure was unstable because the B amount was less than 2 atomic %, and thus the core loss was poor.

In the cases of the invention samples Nos. 12 to 17, the packing factors were 80% or more, the core losses were 0.12 W/kg or less, and thus excellent magnetic properties were obtained.

Example 21

Iron-base amorphous alloy thin strips containing 0.2 atomic % impurity elements such as Mn and S in total with the contents of Fe, Si, B, P and C varied were cast in the same manner as in Example 20. The thickness of the thin strips was 25 μm and the width thereof was 140 mm. The occurrence of air pockets was observed over the entire length of each of the thin strips in the same manner as in Example 19 and the average density of coarse air pockets 500 μm or more in length or 50 μm or more in width was calculated. The thickness deviation in the width direction Δt was measured over the entire length of each of the thin strips, the thin strips were annealed, and then the core losses were measured in the same manner as in Example 20. The results are shown in Table 27.

In any case of the invention samples Nos. 21 to 31 wherein the contents of Fe, Si, B, P, C and B+P were in the respective ranges specified in the present invention, the percentage of the area where the density of the coarse air pockets was $10/cm^2$ or less was 80% or more. Further, the thickness deviations Δt were small and thin strips excellent in the core loss property were obtained.

In contrast, in any of the comparative samples Nos. 32 and 33 wherein the amounts of B+P were less than 12 atomic %, the density of the coarse air pockets exceeded $10/cm^2$ and the core loss was poor. In any of the comparative samples Nos. 19 and 20 wherein the amounts of B+P exceeded 20 atomic %, though the percentage of the area where the density of the coarse air pockets was $10/cm^2$ or less was 80% or more, there were regions where the densities exceeded $10/cm^2$ partially. In these two comparative samples, no further improvement was realized and, what was worse, the magnetic flux densities deteriorated in spite of the fact that the contents of B+P increased.

TABLE 26

| No. | Classification | P content X (at. %) | B content 15.9 − X (at. %) | t max (μm) | t min (μm) | Δt = t max − t min (μm) | Packing factor (%) | Core loss (W/kg) |
|---|---|---|---|---|---|---|---|---|
| 10 | Comparative sample | 0 | 15.9 | 29.2 | 21.3 | 7.9 | 73 | 0.138 |
| 11 | Comparative sample | 0.18 | 15.72 | 28.5 | 22.3 | 6.2 | 75 | 0.125 |
| 12 | Invention sample | 1.2 | 14.7 | 27 | 22 | 5 | 80 | 0.119 |
| 13 | Invention sample | 1.5 | 14.4 | 28.1 | 24.6 | 3.5 | 81 | 0.101 |
| 14 | Invention sample | 3.3 | 12.6 | 27.0 | 24.3 | 2.7 | 82 | 0.095 |
| 15 | Invention sample | 6.4 | 9.5 | 27.1 | 24.6 | 2.5 | 85 | 0.092 |
| 16 | Invention sample | 9.8 | 6.1 | 28.1 | 24.5 | 3.6 | 84 | 0.096 |
| 17 | Invention sample | 10.8 | 5.1 | 27.6 | 24.6 | 3.0 | 82 | 0.097 |
| 18 | Comparative sample | 14.7 | 1.2 | 26.8 | 23.6 | 3.2 | 83 | 0.131 |

TABLE 27

| No. | Classification | Fe content (at. %) | Si content (at. %) | B content (at. %) | P content (at. %) | C content (at. %) | B + P content (at. %) | Number of coarse air pockets (piece/cm$^2$) | Δt (μm) | Core loss (W/kg) |
|---|---|---|---|---|---|---|---|---|---|---|
| 19 | Comparative sample | 75.3 | 2.1 | 14.0 | 8.1 | 0.3 | 22.1 | 8 | 4.5 | 0.101 |
| 20 | Comparative sample | 75.0 | 2.2 | 9.1 | 13.1 | 0.4 | 22.2 | 8 | 4.6 | 0.109 |
| 21 | Invention sample | 78.2 | 2.1 | 13.1 | 6.1 | 0.3 | 19.2 | 6 | 4.4 | 0.097 |
| 22 | Invention sample | 78.1 | 2.2 | 10.2 | 9.1 | 0.2 | 19.3 | 4 | 4.2 | 0.097 |
| 23 | Invention sample | 78.3 | 2.1 | 8.0 | 11.1 | 0.3 | 19.1 | 3 | 3.8 | 0.110 |
| 24 | Invention sample | 80.2 | 2.7 | 12.9 | 3.1 | 0.9 | 16.0 | 2 | 2.7 | 0.102 |
| 25 | Invention sample | 80.5 | 2.4 | 10.1 | 5.8 | 1.0 | 15.9 | 2 | 2.9 | 0.099 |
| 26 | Invention sample | 80.5 | 2.6 | 7.3 | 8.5 | 0.9 | 15.8 | 3 | 3.4 | 0.098 |
| 27 | Invention sample | 80.6 | 2.7 | 5.2 | 10.4 | 0.9 | 15.6 | 3 | 3.8 | 0.096 |
| 28 | Invention sample | 80.6 | 2.6 | 3.8 | 12.0 | 0.8 | 15.8 | 4 | 4.5 | 0.112 |
| 29 | Invention sample | 81.7 | 3.9 | 10.0 | 3.1 | 1.1 | 13.1 | 4 | 4.2 | 0.104 |
| 30 | Invention sample | 82.5 | 3.4 | 6.9 | 6.0 | 1.0 | 12.9 | 4 | 4.2 | 0.102 |
| 31 | Invention sample | 82.9 | 2.6 | 4.2 | 8.9 | 1.2 | 13.1 | 5 | 4.5 | 0.107 |
| 32 | Comparative sample | 84.7 | 4.1 | 7.9 | 1.9 | 1.2 | 9.8 | 14 | 6.8 | 0.123 |
| 33 | Comparative sample | 84.2 | 3.6 | 3.0 | 7.1 | 1.9 | 10.1 | 13 | 7.8 | 0.128 |

Example 22

Each of the alloys having prescribed chemical compositions was melted in a quartz crucible by high frequency induction heating and cast into a thin strip through the single-roll process. Each of the alloy compositions was adjusted by selecting the blend of electrolytic iron, ferroboron, metallic silicon, graphite and ferrophosphorus. In the single-roll process, the molten metal of each of the alloys was sprayed onto a copper-alloy cooling roll through a slot nozzle having a rectangular opening 0.4×25 mm in size and being fixed at the top of the crucible. The diameter of the cooling roll was 580 mm and the rotation speed thereof was 800 rpm.

The thin strips cast in this example had the chemical compositions shown in Table 28, wherein the contents of Fe and P were kept substantially unchanged, the Si contents were lower than the analysable limit, and the contents of B and C were changed. Thin strips about 26 μm in thickness and 25 mm in width were obtained through the casting.

The cast thin strips were cut to a length of 120 mm and then annealed at the temperatures of 320° C., 340° C., 360° C., 380° C. and 400° C. for 1 h. in a nitrogen atmosphere while a magnetic field was applied. Some of the specimens were annealed at a temperature of 420° C. After that, the alternating current magnetic properties of the thin strips were evaluated by using an SST (a single strip tester) and the embrittlement property thereof by 180° bend tests.

The evaluation items were the maximum magnetic flux density $B_{80}$ measured under a maximum impressed magnetic field of 80 A/m and a frequency of 50 Hz, the standard deviation of $B_{80}$, the core loss measured under a maximum magnetic flux density of 1.3 T, the aforementioned annealing temperature ranges $\Delta T_A$ and $\Delta T_B$, and the fracture strain $\epsilon_f$ of a thin strip. The results are shown in Table 28.

The values of $B_{80}$ and the core losses in the table were the maximum and minimum values, respectively, obtained in the annealing temperature ranges indicated in the relevant columns, and the standard deviations of $B_{80}$ were also the deviations in the relevant annealing temperature ranges. An annealing temperature range $\Delta T_A$ was the width of an annealing temperature range wherein the values of $B_{80}$ were 1.35 T or more and the standard deviation of $B_{80}$ was less than 0.1, and an annealing temperature range $\Delta T_B$ was the width of an annealing temperature range wherein the core losses were 0.12 W/kg or less. In some of the samples, the values of $\Delta T_A$ and $\Delta T_B$ were calculated by including the measurement results of the specimens annealed at a temperature of 420° C. A fracture strain $\epsilon_f$ of a thin strip was the minimum value obtained in the annealing temperature range wherein the values of $B_{80}$ were 1.35 T or more and the core losses were 0.12 W/kg or less.

As seen in the results of the invention samples Nos. 2 to 6, when the contents of Fe, B and C were in the respective ranges specified in the present invention, by the effects of the P addition, the values of $B_{80}$ were 1.35 T or more, the standard deviations of $B_{80}$ were less than 0.1, the core losses were 0.12 W/kg or less, and therefore excellent soft magnetic properties were obtained in wide temperature ranges of $\Delta T_A \geqq 80°$ C. and $\Delta T_B \geqq 60°$ C. In addition, the values of $\epsilon_f$ were 0.01 or more and thus an excellent embrittlement resistance was obtained. In the case of the comparative sample No. 1, the C content was low, the values of $B_{80}$ were less than 1.35 T, $\Delta T_A$ was 20° C. or less, and $\Delta T_B$ was 20° C. or less. The results of the comparative sample No. 7 demonstrated that no further improvements were obtained even though the C content exceeded 8 atomic %.

TABLE 28

| Sample | | Chemical composition (at %) | | | | | $B_{80}$(T) | Standard deviation | Core loss (W/kg) | Annealing temperature range (° C.) | | |
|---|---|---|---|---|---|---|---|---|---|---|---|---|
| No. | Classification | Fe | B | Si | C | P | 320–400° C. | of $B_{80}$ | 320–380° C. | $\Delta T_A$ | $\Delta T_B$ | $\epsilon_f$ |
| 1 | Comparative sample | 80.5 | 15.8 | <0.005 | <0.005 | 3.7 | 1.08–1.36 | 0.109 | 0.119–0.139 | 20° C. or lower | 20° C. or lower | 0.008 |
| 2 | Invention sample | 80.4 | 13.0 | <0.005 | 2.8 | 3.8 | 1.39–1.46 | 0.042 | 0.101–0.112 | 80° C. or higher | 60° C. or higher | 0.012 |
| 3 | Invention sample | 80.2 | 11.7 | <0.005 | 3.9 | 4.2 | 1.38–1.46 | 0.035 | 0.100–0.113 | 80° C. or higher | 60° C. or higher | 0.016 |
| 4 | Invention sample | 80.7 | 11.3 | <0.005 | 4.7 | 3.3 | 1.37–1.45 | 0.034 | 0.105–0.115 | 80° C. or higher | 60° C. or higher | 0.014 |
| 5 | Invention sample | 80.3 | 9.9 | <0.005 | 6.2 | 3.6 | 1.37–1.44 | 0.032 | 0.104–0.117 | 80° C. or higher | 60° C. or higher | 0.014 |
| 6 | Invention sample | 80.1 | 9.2 | <0.005 | 7.5 | 3.2 | 1.36–1.44 | 0.036 | 0.108–0.118 | 80° C. or higher | 60° C. or higher | 0.012 |
| 7 | Comparative sample | 80.3 | 8.6 | <0.005 | 8.2 | 2.9 | 1.35–1.42 | 0.035 | 0.107–0.118 | 80° C. or higher | 60° C. or higher | 0.012 |

Example 23

Thin strips were cast in the same manner as in Example 22 by using alloys to which Si was added by less than 2 atomic % that exceeded the amount included inevitably, and evaluated likewise. The results are shown in Table 29. The thickness of the thin strips was 25 μm. In any case of the of invention samples Nos. 8 to 11, the values of $B_{80}$ were 1.35 T or more, the standard deviation of $B_{80}$ was less than 0.1, the core losses were 0.12 W/kg or less, and therefore excellent soft magnetic properties were obtained in wide temperature ranges of $\Delta T \geqq 80°$ C. and $\Delta T \geqq 60°$ C. In addition, the values of $\epsilon_f$ were 0.01 or more and thus an excellent embrittlement resistance was obtained.

TABLE 29

| Sample | | Chemical composition (at %) | | | | | $B_{80}$(T) | Standard deviation | Core loss (W/kg) | Annealing temperature range (° C.) | | |
|---|---|---|---|---|---|---|---|---|---|---|---|---|
| No. | Classification | Fe | B | Si | C | P | 320–400° C. | of $B_{80}$ | 320–380° C. | $\Delta T_A$ | $\Delta T_B$ | $\epsilon_f$ |
| 8 | Invention sample | 80.8 | 12.0 | 0.1 | 3.4 | 3.7 | 1.39–1.46 | 0.033 | 0.101–0.112 | 80° C. or higher | 60° C. or higher | 0.015 |
| 9 | Invention sample | 81.3 | 10.0 | 0.9 | 3.7 | 4.1 | 1.40–1.48 | 0.037 | 0.102–0.112 | 80° C. or higher | 60° C. or higher | 0.014 |
| 10 | Invention sample | 81.9 | 9.6 | 1.3 | 3.5 | 3.7 | 1.42–1.49 | 0.035 | 0.100–0.111 | 80° C. or higher | 60° C. or higher | 0.012 |
| 11 | Invention sample | 82.5 | 9.8 | 1.9 | 2.9 | 2.9 | 1.40–1.50 | 0.045 | 0.108–0.115 | 80° C. or higher | 60° C. or higher | 0.011 |

Example 24

Thin strips having the chemical compositions shown in Table 30, wherein the contents of Fe and Si were kept substantially unchanged and the contents of B, C and P were changed, were cast in the same manner as in Example 22, and evaluated likewise. The results are shown in Table 30. The thickness of the thin strips was 26 μm.

In the case of the comparative sample No. 12 to which P was not added, the standard deviation of $B_{80}$ exceeded 0.1 and thus the magnetic flux densities fluctuated significantly. In the case of the comparative sample No. 19 to which P was added in excess of the content range specified in the present invention, the values of $B_{80}$ were less than 1.35 T.

In the cases of the invention samples Nos. 13 to 18 having the chemical compositions according to the present invention, the values of $B_{80}$ were 1.35 T or more, the standard deviations of $B_{80}$ were less than 0.1, the core losses were 0.12 W/kg or less, and therefore excellent soft magnetic properties were obtained in wide temperature ranges of $\Delta T_A \geqq 80°$ C. and $\Delta T_B \geqq 60°$ C. In addition, the values of $\epsilon_f$ were 0.01 or more and thus an excellent embrittlement resistance was obtained. In particular, in the cases of the invention samples Nos. 14 to 18 wherein the P contents were in the range from 1 to 12 atomic % and the B contents were in the range from more than 5 to less than 14 atomic %, the standard deviations of $B_{80}$ were less than 0.04 and thus the fluctuations of $B_{80}$ were further suppressed.

TABLE 30

| Sample | | Chemical composition (at %) | | | | | $B_{80}$(T) | Standard deviation | Core loss (W/kg) | Annealing temperature range (° C.) | | |
|---|---|---|---|---|---|---|---|---|---|---|---|---|
| No. | Classification | Fe | B | Si | C | P | 320–400° C. | of $B_{80}$ | 320–380° C. | $\Delta T_A$ | $\Delta T_B$ | $\epsilon_f$ |
| 12 | Comparative sample | 80.5 | 14.2 | 1.8 | 3.5 | <0.005 | 1.19–1.41 | 0.105 | 0.118–0.129 | 60° C. or lower | 40° C. or lower | 0.011 |
| 13 | Invention sample | 80.6 | 14.1 | 1.7 | 3.5 | 0.1 | 1.35–1.45 | 0.042 | 0.105–0.119 | 80° C. or higher | 60° C. or higher | 0.012 |
| 14 | Invention sample | 80.7 | 12.9 | 1.8 | 3.4 | 1.2 | 1.37–1.46 | 0.034 | 0.103–0.118 | 80° C. or higher | 60° C. or higher | 0.015 |
| 15 | Invention sample | 80.4 | 10.9 | 1.9 | 3.6 | 3.2 | 1.39–1.48 | 0.033 | 0.098–0.109 | 80° C. or higher | 60° C. or higher | 0.014 |
| 16 | Invention sample | 80.6 | 7.1 | 1.8 | 3.7 | 6.8 | 1.38–1.46 | 0.030 | 0.102–0.112 | 80° C. or higher | 60° C. or higher | 0.014 |
| 17 | Invention sample | 80.6 | 4.2 | 1.9 | 3.6 | 9.7 | 1.37–1.46 | 0.034 | 0.102–0.113 | 80° C. or higher | 60° C. or higher | 0.013 |
| 18 | Invention sample | 80.4 | 5.2 | 1.7 | 1.8 | 10.9 | 1.36–1.44 | 0.035 | 0.100–0.114 | 80° C. or higher | 60° C. or higher | 0.013 |
| 19 | Comparative sample | 80.3 | 2.2 | 1.8 | 1.9 | 13.8 | 1.25–1.34 | 0.035 | 0.105–0.116 | — | 60° C. or higher | 0.012 |

Example 25

Thin strips having the chemical compositions shown in Table 31, wherein the contents of Si, C and P were kept substantially unchanged and the contents of Fe and B were changed, were cast in the same manner as in Example 22, and evaluated likewise. The results are shown in Table 31. The thickness of the thin strips was 24 μm.

In the case of the comparative sample No. 20 having the Fe content in excess of 86 atomic %, since an amorphous thin strip could not be cast stably, the values of $B_{80}$ were low and the core losses were high. Furthermore, the specimens cracked so easily in the bend tests that it was impossible to measure the value of $\epsilon_f$. In the case of the comparative sample No. 27 having the Fe content of less than 78 atomic %, $\Delta T_A$ was less than 80° C.

In the cases of the invention samples Nos. 21 to 26 having the chemical compositions according to the present invention, the values of $B_{80}$ were 1.35 T or more, the standard deviations of $B_{80}$ were less than 0.1, the core losses were 0.12 W/kg or less, and therefore excellent soft magnetic properties were obtained in wide temperature ranges of $\Delta T_A \geqq 80°$ C. and $\Delta T_B \geqq 60°$ C. In addition, the values of $\epsilon_f$ were 0.01 or more and thus an excellent embrittlement resistance was obtained. In particular, in the cases of the invention samples Nos. 23 and 24 wherein the Fe contents were in the range from more than 80 to 82 atomic %, the standard deviations of $B_{80}$ were less than 0.04 and thus the fluctuations of $B_{80}$ were further suppressed. In the cases of the invention samples Nos. 23 to 26 wherein the Fe contents were 82 atomic % or less, the values of $\epsilon_f$ were particularly high and thus the embrittlement resistance was further enhanced.

TABLE 31

| Sample | | Chemical composition (at %) | | | | | $B_{80}$(T) | Standard deviation of | Core loss (W/kg) | Annealing temperature range (° C.) | | |
|---|---|---|---|---|---|---|---|---|---|---|---|---|
| No. | Classification | Fe | B | Si | C | P | 320–400° C. | $B_{80}$ | 320–380° C. | $\Delta T_A$ | $\Delta T_B$ | $\epsilon_f$ |
| 20 | Comparative sample | 87.0 | 6.0 | 1.4 | 2.1 | 3.5 | 0.22–0.82 | 0.215 | 0.456–8.062 | — | — | Not evaluable |
| 21 | Invention sample | 84.5 | 7.8 | 1.5 | 2.5 | 3.7 | 1.35–1.46 | 0.048 | 0.102–0.120 | 80° C. or higher | 60° C. or higher | 0.010 |
| 22 | Invention sample | 83.2 | 8.9 | 1.5 | 2.8 | 3.6 | 1.38–1.47 | 0.042 | 0.102–0.118 | 80° C. or higher | 60° C. or higher | 0.011 |
| 23 | Invention sample | 81.7 | 9.6 | 1.5 | 3.5 | 3.7 | 1.41–1.48 | 0.034 | 0.099–0.110 | 80° C. or higher | 60° C. or higher | 0.015 |
| 24 | Invention sample | 80.3 | 11.7 | 1.4 | 3.2 | 3.4 | 1.42–1.48 | 0.028 | 0.100–0.112 | 80° C. or higher | 60° C. or higher | 0.016 |
| 25 | Invention sample | 79.1 | 12.5 | 1.5 | 3.3 | 3.6 | 1.36–1.47 | 0.041 | 0.108–0.116 | 80° C. or higher | 60° C. or higher | 0.015 |
| 26 | Invention sample | 78.2 | 13.4 | 1.4 | 3.5 | 3.5 | 1.36–1.42 | 0.040 | 0.109–0.118 | 80° C. or higher | 60° C. or higher | 0.015 |
| 27 | Comparative sample | 77.1 | 14.3 | 1.5 | 3.6 | 3.5 | 1.33–1.36 | 0.039 | 0.108–0.117 | 60° C. or lower | 60° C. or higher | 0.014 |

Example 26

Each of the alloys having prescribed chemical compositions was melted in a quartz crucible by high frequency induction heating and cast into a thin strip through the single-roll process. Each of the alloy compositions was adjusted by selecting the blend of electrolytic iron, ferroboron, metallic silicon, graphite, ferrophosphorus, etc. In the single-roll process, the molten metal of each of the alloys was sprayed onto a copper-alloy cooling roll through a slot nozzle having a rectangular opening 0.4×25 mm in size and being fixed at the top of the crucible. The diameter of the cooling roll was 580 mm and the rotation speed thereof was 800 rpm.

The thin strips cast in this example had the chemical compositions shown in Table 32, wherein the contents of Fe, Si and C were kept substantially unchanged and the contents of B and S as an element of M were changed. Thin strips about 24 μm in thickness and 25 mm in width were obtained through the casting. All the thin strips contained impurity elements such as Mn at 0.2 atomic % in total.

The cast thin strips were cut to a length of 120 mm and then annealed at the temperatures of 320° C., 340° C., 360° C., 380° C. and 400° C. for 1 h. in a nitrogen atmosphere while a magnetic field was applied. Some of the specimens were annealed at a temperature of 420° C. After that, the alternating current magnetic properties of the thin strips were evaluated by using an SST (a single strip tester) and the embrittlement property thereof by 180° bend tests.

TABLE 32

| Sample | | Chemical composition (at %) | | | | | $B_{80}$(T) | Standard deviation | Core loss (W/kg) | Annealing temperature range (° C.) | | |
|---|---|---|---|---|---|---|---|---|---|---|---|---|
| No. | Classification | Fe | B | Si | C | S | 320–400° C. | of $B_{80}$ | 320–380° C. | $\Delta T_A$ | $\Delta T_B$ | $\epsilon_f$ |
| 1 | Comparative sample | 80.4 | 15.9 | 2.5 | 1.0 | <0.005 | 1.15–1.42 | 0.121 | 0.117–0.127 | 60° C. or lower | 40° C. or lower | 0.010 |
| 2 | Invention sample | 80.5 | 15.1 | 2.6 | 1.1 | 0.5 | 1.35–1.46 | 0.046 | 0.104–0.120 | 80° C. or higher | 60° C. or higher | 0.011 |
| 3 | Invention sample | 80.7 | 13.9 | 2.5 | 1.2 | 1.5 | 1.36–1.46 | 0.038 | 0.104–0.119 | 80° C. or higher | 60° C. or higher | 0.013 |
| 4 | Invention sample | 80.5 | 12.7 | 2.5 | 1.0 | 3.1 | 1.38–1.47 | 0.035 | 0.099–0.110 | 80° C. or higher | 60° C. or higher | 0.013 |
| 5 | Invention sample | 80.5 | 9.0 | 2.6 | 1.0 | 6.7 | 1.38–1.46 | 0.033 | 0.101–0.113 | 80° C. or higher | 60° C. or higher | 0.014 |
| 6 | Invention sample | 80.5 | 5.7 | 2.5 | 1.2 | 9.9 | 1.37–1.45 | 0.035 | 0.101–0.112 | 80° C. or higher | 60° C. or higher | 0.012 |
| 7 | Invention sample | 80.3 | 5.5 | 2.4 | 1.0 | 10.6 | 1.35–1.43 | 0.035 | 0.102–0.115 | 80° C. or higher | 60° C. or higher | 0.011 |
| 8 | Comparative sample | 80.4 | 2.1 | 2.5 | 0.9 | 13.9 | 1.22–1.33 | 0.036 | 0.104–0.117 | — | 60° C. or higher | 0.011 |

The evaluation items were the maximum magnetic flux density $B_{80}$ measured under a maximum impressed magnetic field of 80 A/m and a frequency of 50 Hz, the standard deviation of $B_{80}$, the core loss measured under a maximum magnetic flux density of 1.3 T, the aforementioned annealing temperature ranges $\Delta T_A$ and $\Delta T_B$, and the fracture strain $\epsilon_f$ of a thin strip. The results are shown in Table 32.

The values of $B_{80}$ and the core losses in the table were the maximum and minimum values, respectively, obtained in the annealing temperature ranges indicated in the relevant columns, and the standard deviations of $B_{80}$ were also the deviations in the relevant annealing temperature ranges. An annealing temperature range $\Delta T_A$ was the width of an annealing temperature range wherein the values of $B_{80}$ were 1.35 T or more and the standard deviation of $B_{80}$ was less than 0.1, and an annealing temperature range $\Delta T_B$ was the width of an annealing temperature range wherein the core losses were 0.12 W/kg or less. In some of the samples, the values of $\Delta T_A$ and $\Delta T_B$ were calculated by including the measurement results of the specimens annealed at a temperature of 420° C. A fracture strain $\epsilon_f$ of a thin strip was the minimum value obtained in the annealing temperature range wherein the value of $B_{80}$ were 1.35 T or more and the core losses were 0.12 W/kg or less.

In the case of the comparative sample No. 1 to which S was not added, the standard deviation of $B_{80}$ was 0.1 or more and thus the magnetic flux densities fluctuated significantly. In the case of the comparative sample No. 8 to which S was added in excess of the content range specified in the present invention, the values of $B_{80}$ were less than 1.35 T.

In the cases of the invention samples Nos. 2 to 7 having the chemical compositions according to the present invention, the values of $B_{80}$ were 1.35 T or more, the standard deviations of $B_{80}$ were less than 0.1, the core losses were 0.12 W/kg or less, and therefore excellent soft magnetic properties were obtained in wide temperature ranges of $\Delta T_A \geqq 80°$ C. and $\Delta T_B \geqq 60°$ C. In addition, the values of $\epsilon_f$ were 0.01 or more and thus an excellent embrittlement resistance was obtained. In particular, in the cases of the invention samples Nos. 3 to 7 wherein the S contents were in the range from 1 to 12 atomic % and the B contents were in the range from more than 5 to less than 14 atomic %, the standard deviations of $B_{80}$ were less than 0.04 and thus the fluctuations of $B_{80}$ were further suppressed.

Example 27

Thin strips having the chemical compositions shown in Table 33, wherein the contents of Fe, Si and C were kept substantially unchanged and the contents of B and M were changed, were cast in the same manner as in Example 26. All the thin strips contained impurity elements such as Mn by 0.2 atomic % in total. The thickness of the thin strips was 25 μm. The results obtained in the evaluations carried out also in the same manner as in Example 26 are shown in Table 33.

In any case of the invention samples Nos. 9 to 15 to which some of As, Bi, S, Se and Te were added as the element M in combination by a total amount in the range specified in the present invention, the values of $B_{80}$ were 1.35 T or more, the standard deviation of $B_{80}$ was less than 0.1, the core losses were 0.12 W/kg or less, and therefore excellent soft magnetic properties were obtained in wide temperature ranges of $\Delta T_A \geqq 80°$ C. and $\Delta T_B \geqq 60°$ C., and furthermore the value of $\epsilon_f$ was 0.01 or more and thus an excellent embrittlement resistance was obtained.

TABLE 33

| Sample | | Chemical composition (at %) | | | | | $B_{80}$(T) | Standard deviation | Core loss (W/kg) | Annealing temperature range (° C.) | | |
|---|---|---|---|---|---|---|---|---|---|---|---|---|
| No. | Classification | Fe | B | Si | C | M | 320–400° C. | of $B_{80}$ | 320–380° C. | $\Delta T_A$ | $\Delta T_B$ | $\epsilon_f$ |
| 9 | Invention sample | 80.5 | 14.0 | 2.6 | 1.0 | As = 0.8 Bi = 0.9 | 1.35–1.45 | 0.045 | 0.105–0.119 | 80° C. or higher | 60° C. or higher | 0.011 |
| 10 | Invention sample | 80.7 | 12.9 | 2.5 | 1.0 | Bi = 1.2 S = 1.5 | 1.36–1.45 | 0.042 | 0.108–0.120 | 80° C. or higher | 60° C. or higher | 0.012 |
| 11 | Invention sample | 80.7 | 11.6 | 2.6 | 1.1 | S = 3.2 Se = 0.6 | 1.35–1.46 | 0.047 | 0.107–0.118 | 80° C. or higher | 60° C. or higher | 0.010 |
| 12 | Invention sample | 80.5 | 15.1 | 2.5 | 1.0 | Se = 0.5 Te = 0.2 | 1.36–1.45 | 0.044 | 0.112–0.119 | 80° C. or higher | 60° C. or higher | 0.011 |
| 13 | Invention sample | 80.5 | 14.5 | 2.5 | 1.0 | Te = 0.3 As = 1.0 | 1.36–1.44 | 0.039 | 0.114–0.120 | 80° C. or higher | 60° C. or higher | 0.013 |
| 14 | Invention sample | 80.5 | 8.8 | 2.5 | 1.1 | S = 6.8 As = 0.1 | 1.37–1.44 | 0.032 | 0.109–0.119 | 80° C. or higher | 60° C. or higher | 0.011 |
| 15 | Invention sample | 80.3 | 6.0 | 2.6 | 1.0 | S = 9.8 Te = 0.1 | 1.35–1.43 | 0.035 | 0.101–0.115 | 80° C. or higher | 60° C. or higher | 0.012 |

Example 28

Thin strips having the chemical compositions shown in Table 34, wherein the contents of Fe, Si and C were kept substantially unchanged and the contents of B and P+M were changed, were cast in the same manner as in Example 26. All the thin strips contained impurity elements such as Mn by 0.2 atomic % in total. The thickness of the thin strips was 25 μm. The results obtained in the evaluations carried out also in the same manner as in Example 26 are shown in Table 34.

In the case of the comparative sample No. 16 wherein the content of P+M was less than 0.2 atomic %, the standard deviation $B_{80}$ was 0.1 or more and thus the magnetic flux densities fluctuated significantly. In the case of the comparative sample No. 23 wherein the content of P+M exceeded 12 atomic %, the values of $B_{80}$ were less than 1.35 T.

In the cases of the invention samples Nos. 17 to 22 having the chemical compositions according to the present invention, the values of $B_{80}$ were 1.35 T or more, the standard deviations of $B_{80}$ were less than 0.1, the core losses were 0.12 W/kg or less, and therefore excellent soft magnetic properties were obtained in wide temperature ranges of $\Delta T_A \geqq 80°$ C. and $\Delta T_B \geqq 60°$ C. and, furthermore, the values of $\epsilon_f$ were 0.01 or more and thus an excellent embrittlement resistance was obtained. In particular, in the cases of the invention samples Nos. 17 to 22 wherein the contents of P+M were in the range from 1 to 12 atomic % and the contents of B were in the range from more than 5 to less than 14 atomic %, the standard deviations of $B_{80}$ were less than 0.04 and thus the fluctuations of $B_{80}$ were further suppressed.

TABLE 34

| Sample | | Chemical composition (at %) | | | | | $B_{80}$(T) | Standard deviation | Core loss (W/kg) | Annealing temperature range (° C.) | | |
|---|---|---|---|---|---|---|---|---|---|---|---|---|
| No. | Classification | Fe | B | Si | C | P + M | 320–400° C. | of $B_{80}$ | 320–380° C. | $\Delta T_A$ | $\Delta T_B$ | $\epsilon_f$ |
| 16 | Comparative sample | 80.3 | 15.8 | 2.5 | 1.1 | P = 0.05 S = 0.05 | 1.12–1.37 | 0.112 | 0.112–0.129 | 40° C. or lower | 40° C. or lower | 0.011 |
| 17 | Invention sample | 80.5 | 13.9 | 2.6 | 1.0 | P = 1.2 S = 0.6 | 1.35–1.45 | 0.038 | 0.104–0.120 | 80° C. or higher | 60° C. or higher | 0.012 |
| 18 | Invention sample | 80.6 | 10.9 | 2.4 | 0.9 | P = 3.5 S = 1.5 | 1.38–1.47 | 0.035 | 0.099–0.110 | 80° C. or higher | 60° C. or higher | 0.013 |
| 19 | Invention sample | 80.7 | 11.9 | 2.5 | 1.0 | P = 3.5 As = 0.2 | 1.37–1.48 | 0.038 | 0.101–0.112 | 80° C. or higher | 60° C. or higher | 0.011 |
| 20 | Invention sample | 80.7 | 8.6 | 2.6 | 1.1 | P = 6.5 Se = 0.3 | 1.38–1.49 | 0.037 | 0.102–0.119 | 80° C. or higher | 60° C. or higher | 0.013 |
| 21 | Invention sample | 80.5 | 5.8 | 2.5 | 1.0 | P = 9.8 Te = 0.2 | 1.37–1.46 | 0.035 | 0.100–0.113 | 80° C. or higher | 60° C. or higher | 0.011 |
| 22 | Invention sample | 80.4 | 5.1 | 2.3 | 0.9 | P = 10.9 Bi = 0.2 | 1.35–1.43 | 0.036 | 0.101–0.114 | 80° C. or higher | 60° C. or higher | 0.012 |
| 23 | Comparative sample | 80.5 | 2.4 | 2.5 | 1.1 | P = 13.2 As = 0.1 | 1.24–1.33 | 0.037 | 0.106–0.118 | — | 60° C. or higher | 0.012 |

Example 29

Thin strips having the chemical compositions shown in Table 35, wherein the contents of Fe, C and M were kept substantially unchanged and the contents of B and Si were changed, were cast in the same manner as in Example 26. All the thin strips contained impurity elements such as Mn by 0.2 atomic % in total. The thickness of the thin strips was 24 μm. The results obtained in the evaluations carried out also in the same manner as in Example 26 are shown in Table 35.

In the cases of the comparative samples Nos. 24 and 28 wherein the Si contents were outside the range specified in the present invention, the standard deviations of $B_{80}$ were 0.1 or more and thus the magnetic flux densities fluctuated significantly.

In the cases of the invention samples Nos. 25 to 27 having the chemical compositions according to the present invention, the values of $B_{80}$ were 1.35 T or more, the standard deviations of $B_{80}$ were less than 0.1, the core losses were 0.12 W/kg or less, and therefore excellent soft magnetic properties were obtained in wide temperature ranges of $\Delta T_A \geqq 80°$ C. and $\Delta T_B \geqq 60°$ C., and furthermore the values of $\epsilon_f$ were 0.01 or more and thus an excellent embrittlement resistance was obtained.

TABLE 35

| Sample | | Chemical composition (at %) | | | | | $B_{80}$(T) | Standard deviation of | Core loss (W/kg) | Annealing temperature range (° C.) | | |
|---|---|---|---|---|---|---|---|---|---|---|---|---|
| No. | Classification | Fe | B | Si | C | M | 320–400° C. | $B_{80}$ | 320–380° C. | $\Delta T_A$ | $\Delta T_B$ | $\epsilon_f$ |
| 24 | Comparative sample | 80.5 | 13.3 | 1.8 | 1.0 | P = 2.8<br>S = 0.4 | 1.18–1.42 | 0.104 | 0.112–0.135 | 60° C. or lower | 40° C. or lower | 0.011 |
| 25 | Invention sample | 80.4 | 12.7 | 2.4 | 1.1 | As = 0.3<br>Bi = 0.9<br>P = 2.0 | 1.36–1.46 | 0.039 | 0.101–0.115 | 80° C. or higher | 60° C. or higher | 0.012 |
| 26 | Invention sample | 80.5 | 11.8 | 3.2 | 1.0 | Bi = 1.1<br>Se = 0.3<br>P = 1.9 | 1.37–1.45 | 0.032 | 0.109–0.118 | 80° C. or higher | 60° C. or higher | 0.011 |
| 27 | Invention sample | 80.6 | 11.1 | 3.8 | 1.0 | Te = 0.2<br>P = 3.1 | 1.36–1.45 | 0.038 | 0.108–0.117 | 80° C. or higher | 60° C. or higher | 0.013 |
| 28 | Comparative sample | 80.7 | 10.3 | 4.5 | 0.9 | As = 0.3<br>S = 0.5<br>P = 2.6 | 1.22–1.48 | 0.110 | 0.104–0.140 | 60° C. or lower | 40° C. or lower | 0.011 |

Example 30

Thin strips having the chemical compositions shown in Table 36, wherein the contents of M and Si were kept substantially unchanged and the contents of Fe, B and C were changed, were cast in the same manner as in Example 26. All the thin strips contained impurity elements such as Mn by 0.2 atomic % in total. The thickness of the thin strips was 26 μm. The results obtained in the evaluations carried out also in the same manner as in Example 26 are shown in Table 36.

In the case of the comparative sample No. 29 having the Fe content in excess of 86 atomic %, as an amorphous thin strip could not be cast stably, the values of $B_{80}$ were low and the core losses were high. Furthermore, the specimens cracked so easily at the bend tests that it was impossible to measure the value of $\epsilon_f$. In the case of the comparative sample No. 35 having the Fe content of less than 78 atomic %, $\Delta T_A$ was less than 80° C.

In the cases of the invention samples Nos. 30 to 34 having the chemical compositions according to the present invention, the values of $B_{80}$ were 1.35 T or more, the standard deviations of $B_{80}$ were less than 0.1, the core losses were 0.12 W/kg or less, and therefore excellent soft magnetic properties were obtained in wide temperature ranges of $\Delta T_A \geqq 80°$ C. and $\Delta T_B \geqq 60°$ C., and furthermore the values of $\epsilon_f$ were 0.01 or more and thus an excellent embrittlement resistance was obtained. In particular, in the cases of the invention samples Nos. 32 and 33 wherein the Fe contents were in the range from more than 80 to 82 atomic %, the standard deviations of $B_{80}$ were less than 0.04 and thus the fluctuations of $B_{80}$ were further suppressed.

TABLE 36

| Sample | | Chemical composition (at %) | | | | | $B_{80}$(T) | Standard deviation of | Core loss (W/kg) | Annealing temperature range (° C.) | | |
|---|---|---|---|---|---|---|---|---|---|---|---|---|
| No. | Classification | Fe | B | Si | C | M | 320–400° C. | $B_{80}$ | 320–380° C. | $\Delta T_A$ | $\Delta T_B$ | $\epsilon_f$ |
| 29 | Comparative sample | 86.8 | 7.2 | 2.5 | 0.2 | P = 2.7<br>S = 0.4 | 0.19–0.75 | 0.221 | 0.532–9.025 | — | — | Not evaluable |
| 30 | Invention sample | 84.4 | 9.7 | 2.4 | 0.3 | As = 0.3<br>P = 2.7 | 1.35–1.45 | 0.045 | 0.103–0.120 | 80° C. or higher | 60° C. or higher | 0.012 |
| 31 | Invention sample | 83.4 | 10.3 | 2.5 | 0.5 | Bi = 0.9<br>P = 2.2 | 1.36–1.46 | 0.042 | 0.103–0.117 | 80° C. or higher | 60° C. or higher | 0.013 |
| 32 | Invention sample | 81.6 | 12.0 | 2.3 | 0.7 | Te = 0.2<br>P = 3.0 | 1.38–1.49 | 0.038 | 0.100–0.115 | 80° C. or higher | 60° C. or higher | 0.014 |
| 33 | Invention sample | 80.2 | 13.0 | 2.5 | 1.0 | Se = 0.3<br>P = 2.8 | 1.39–1.49 | 0.037 | 0.101–0.116 | 80° C. or higher | 60° C. or higher | 0.014 |

TABLE 36-continued

| Sample | | Chemical composition (at %) | | | | | $B_{80}$(T) | Standard deviation of | Core loss (W/kg) | Annealing temperature range (° C.) | | |
|---|---|---|---|---|---|---|---|---|---|---|---|---|
| No. | Classification | Fe | B | Si | C | M | 320–400° C. | $B_{80}$ | 320–380° C. | $\Delta T_A$ | $\Delta T_B$ | $\epsilon_f$ |
| 34 | Invention sample | 78.8 | 13.6 | 2.5 | 1.7 | P = 2.8<br>S = 0.4 | 1.36–1.46 | 0.043 | 0.102–0.117 | 80° C. or higher | 60° C. or higher | 0.013 |
| 35 | Comparative sample | 77.2 | 15.4 | 2.4 | 1.6 | As = 0.3<br>Bi = 0.9<br>P = 2.0 | 1.32–1.37 | 0.041 | 0.109–0.120 | 60° C. or lower | 60° C. or higher | 0.013 |

Example 31

Thin strips were cast through the single-roll process by using alloys having the chemical composition, in atomic percentage, of $Fe_{80.2}Si_{2.6}B_{16-Z}P_ZC_1$ and containing X mass % Al and 0.2 atomic % impurity elements such as Mn and S in total, wherein the values of X and Z were varied as shown in Table 37. Ordinary steel deoxidized with Al was used as the iron source for the material alloys.

Each of the alloy compositions was adjusted by blending ferroboron, metallic silicon, graphite, ferrophosphorus and metallic aluminum to the iron source. Each of the alloys was melted in a quartz crucible by high frequency induction heating and cast into the thin strips by spraying the molten metal onto a copper-alloy cooling roll through a slot nozzle having a rectangular opening 0.4×25 mm in size and being fixed at the top of the crucible. The diameter of the cooling roll was 580 mm and the rotation speed thereof was 800 rpm. The thickness of the cast thin strips was 25 μm and the width thereof was 25 mm.

The cast thin strips were annealed at a temperature of 360° C. for 1 h. in a nitrogen atmosphere while a magnetic field was applied. After that, the core losses were measured under the conditions specified earlier by using single-strip test pieces 25 mm in width. The results are shown in Table 37.

In any case of the invention samples Nos. 1 to 5 to which P was added, the core loss was 0.12 W/kg or less and thus excellent properties were obtained even though Al was contained, and therefore it was understood that the crystallization caused by Al was remarkably suppressed. In any case of the comparative samples Nos. 6 to 10 to which P was not added, the core loss was high.

TABLE 37

| No. | Classification | Al content X (mass %) | P content Z (at. %) | Core loss (W/kg) |
|---|---|---|---|---|
| 1 | Invention sample | 0.01 | 1.2 | 0.104 |
| 2 | Invention sample | 0.18 | 2.3 | 0.108 |
| 3 | Invention sample | 0.51 | 3.6 | 0.113 |
| 4 | Invention sample | 0.81 | 6.5 | 0.114 |
| 5 | Invention sample | 0.98 | 9.1 | 0.120 |
| 6 | Comparative sample | 0.01 | 0 | 0.18 |
| 7 | Comparative sample | 0.19 | 0 | 0.21 |
| 8 | Comparative sample | 0.50 | 0 | 0.24 |

TABLE 37-continued

| No. | Classification | Al content X (mass %) | P content Z (at. %) | Core loss (W/kg) |
|---|---|---|---|---|
| 9 | Comparative sample | 0.80 | 0 | 0.28 |
| 10 | Comparative sample | 0.97 | 0 | 0.31 |

Example 32

Thin strips were cast in the same manner as in Example 31 by using alloys having the chemical composition, in atomic percentage, of $Fe_{80.4}Si_{2.5}B_{16-Z}P_ZC_1$ and containing Y mass % Ti and 0.2 atomic % impurity elements such as Mn and S in total, wherein the values of Y and Z were varied as shown in Table 38. The thin strips were then annealed and the core losses thereof were measured also in the same manner as in Example 31. The results are shown in Table 38. Here, ordinary steel deoxidized with Si was used as the iron source for the material alloys and each of the alloy compositions was adjusted by blending ferroboron, metallic silicon, graphite, ferrophosphorus and metallic titanium to the iron source. The thickness of the thin strips was 25 μm.

In any case of the invention samples Nos. 11 to 15 to which P was added, the core loss was 0.12 W/kg or less and thus excellent properties were obtained even though Ti was contained, and therefore it was understood that the crystallization caused by Ti was remarkably suppressed. In any case of the comparative samples Nos. 16 to 20 to which P was not added, the core loss was high.

TABLE 38

| No. | Classification | Ti content Y (mass %) | P content Z (at. %) | Core loss (W/kg) |
|---|---|---|---|---|
| 11 | Invention sample | 0.01 | 1.4 | 0.101 |
| 12 | Invention sample | 0.38 | 2.8 | 0.102 |
| 13 | Invention sample | 0.85 | 5.9 | 0.112 |
| 14 | Invention sample | 1.38 | 6.2 | 0.117 |
| 15 | Invention sample | 1.5 | 7.2 | 0.119 |
| 16 | Comparative sample | 0.01 | 0 | 0.21 |
| 17 | Comparative sample | 0.39 | 0 | 0.23 |
| 18 | Comparative sample | 0.83 | 0 | 0.29 |
| 19 | Comparative sample | 1.40 | 0 | 0.32 |

TABLE 38-continued

| No. | Classification | Ti content Y (mass %) | P content Z (at. %) | Core loss (W/kg) |
|---|---|---|---|---|
| 20 | Comparative sample | 1.49 | 0 | 0.32 |

Example 33

Thin strips having the chemical compositions shown in Table 39, wherein the Si contents were less than the analyzable limit, were cast and annealed in the same manner as in Example 31, and then the core losses thereof were measured also in the same manner as in Example 31. The results are shown in Table 39. Here, electrolytic iron was used as the iron source of the material alloys and each of the alloy compositions was adjusted by blending ferroboron, graphite, ferrophosphorus, metallic aluminum, and metallic titanium to the iron source. The thickness of the thin strips was 24 μm.

In any case of the invention samples Nos. 21 to 23 to which P was added, the core loss was 0.12 W/kg or less and excellent properties were obtained even though Al or Ti was contained, and therefore it was understood that the crystallization caused by Al or Ti was remarkably suppressed. In any case of the comparative samples Nos. 22 and 24 to which P was not added, the core loss was high.

TABLE 39

| | | Contents of main elements (at. %) | | | | | Contents of other elements (mass %) | | Core loss |
|---|---|---|---|---|---|---|---|---|---|
| No. | Classification | Fe | B | Si | C | P | Al | Ti | (W/kg) |
| 21 | Invention sample | 80.7 | 11.3 | <0.005 | 4.7 | 3.3 | 0.17 | <0.005 | 0.112 |
| 22 | Comparative sample | 80.6 | 14.6 | <0.005 | 4.8 | <0.005 | 0.17 | <0.005 | 0.220 |
| 23 | Invention sample | 80.7 | 11.3 | <0.005 | 4.7 | 3.3 | <0.005 | 0.24 | 0.110 |
| 24 | Comparative sample | 80.5 | 14.7 | <0.005 | 4.8 | <0.005 | <0.005 | 0.24 | 0.240 |

Example 34

Thin strips having the chemical compositions shown in Table 40, wherein the contents of Fe, Si and C were kept substantially unchanged, the contents of M (a combination of some of P, As, Bi, S, Se and Te) and B were changed, and 0.2 atomic % impurity elements such as Mn and S in total were contained, were cast in the same manner as in Example 31. The thin strips were then annealed and the core losses were measured also in the same manner as in Example 31. The results are shown in Table 40. Ordinary steel deoxidized with Al or Si was used as the iron source for the material alloys and each of the alloy compositions was adjusted by blending ferroboron, metallic silicon, graphite, metallic aluminum, metallic titanium and the component M to the iron source. The thickness of the thin strips was 24 μm.

In any of the invention samples Nos. 25 to 31 to which the component M was added, the core loss was 0.12 W/kg or less and thus excellent properties were obtained even though Al or Ti was contained, and therefore it was understood that the crystallization caused by Al or Ti was remarkably suppressed. In any of the comparative samples Nos. 32 and 33 to which the component M was not added, the core loss was high.

TABLE 40

| | | Contents of main elements (at. %) | | | | | Contents of other elements (mass %) | | Core loss |
|---|---|---|---|---|---|---|---|---|---|
| No. | Classification | Fe | B | Si | C | M | Al | Ti | (W/kg) |
| 25 | Invention sample | 80.4 | 14.0 | 2.7 | 1.0 | As = 0.7<br>Bi = 1.0 | 0.15 | <0.005 | 0.109 |

TABLE 40-continued

| No. | Classification | Contents of main elements (at. %) Fe | B | Si | C | M | Contents of other elements (mass %) Al | Ti | Core loss (W/kg) |
|---|---|---|---|---|---|---|---|---|---|
| 26 | Invention sample | 80.5 | 13.1 | 2.5 | 1.1 | Bi = 1.2<br>B = 1.4 | <0.005 | 0.22 | 0.112 |
| 27 | Invention sample | 80.6 | 11.7 | 2.7 | 1.0 | S = 3.3<br>Se = 0.5 | 0.16 | <0.005 | 0.108 |
| 28 | Invention sample | 80.6 | 15.0 | 2.4 | 1.1 | Se = 0.4<br>Te = 0.3 | 0.14 | <0.005 | 0.113 |
| 29 | Invention sample | 80.6 | 14.4 | 2.4 | 1.1 | Te = 0.2<br>As = 1.1 | <0.005 | 0.21 | 0.118 |
| 30 | Invention sample | 80.7 | 8.6 | 2.6 | 1.0 | S = 6.5<br>As = 0.4 | <0.005 | 0.24 | 0.115 |
| 31 | Invention sample | 80.4 | 5.9 | 2.6 | 1.0 | S = 9.7<br>Te = 0.2 | 0.10 | <0.005 | 0.114 |
| 32 | Comparative sample | 80.4 | 15.5 | 2.7 | 1.2 | <0.005 | 0.16 | <0.005 | 0.223 |
| 33 | Comparative sample | 80.6 | 15.7 | 2.4 | 1.1 | <0.005 | <0.005 | 0.23 | 0.245 |

Example 35

Thin strips having the chemical compositions shown in Table 41, wherein the contents of Fe, C and M were kept substantially unchanged, the contents of B and Si were changed, and 0.2 atomic % impurity elements such as Mn and S in total were contained, were cast in the same manner as in Example 31. The thin strips were then annealed and the core losses thereof were measured also in the same manner as in Example 31. The results are shown in Table 41. ordinary steel deoxidized with Al was used as the iron source for the material alloys and each of the alloy compositions was adjusted by blending ferroboron, metallic silicon, graphite, metallic aluminum, metallic titanium and the component M to the iron source. The thickness of the thin strips was 25 μm.

In any of the invention samples Nos. 34 to 36 to which the component M was added, the core loss was 0.12 W/kg or less and thus excellent properties were obtained even though Al or Ti was contained, and therefore it was understood that the crystallization caused by Al or Ti was remarkably suppressed.

TABLE 41

| No. | Classification | Contents of main elements (at. %) Fe | B | Si | C | M | Contents of other elements (mass %) Al | Ti | Core loss (W/kg) |
|---|---|---|---|---|---|---|---|---|---|
| 34 | Invention sample | 80.5 | 12.5 | 2.5 | 1.1 | As = 0.2<br>Bi = 0. 9<br>P = 2.1 | 0.09 | 0.14 | 0.117 |
| 35 | Invention sample | 80.4 | 11.9 | 3.2 | 1.0 | Bi = 1.0<br>Se = 0.3<br>P = 2.0 | 0.08 | 0.15 | 0.115 |
| 36 | Invention sample | 80.5 | 11.2 | 3.8 | 1.0 | Te = 0.1<br>P = 3.2 | 0.09 | 0.17 | 0.118 |

Example 36

Thin strips having the chemical compositions shown in Table 42, wherein the contents of M and Si were kept substantially unchanged, the contents of Fe, B and C were changed, and 0.2 atomic % impurity elements such as Mn and S in total were contained, were cast in the same manner as in Example 31. The thin strips were then annealed and the core losses were measured also in the same manner as in Example 31. The results are shown in Table 42. Ordinary steel deoxidized with Al or Si was used as the iron source for the material alloys and each of the alloy compositions was adjusted by blending ferroboron, metallic silicon, graphite, metallic aluminum, metallic titanium and the component M to the iron source. The thickness of the thin strips was 25 μm.

In any case of the invention samples Nos. 37 to 41 to which the component M was added, the core loss was 0.12 W/kg or less and thus excellent properties were obtained even though Al or Ti was contained, and therefore it was understood that the crystallization caused by Al or Ti was remarkably suppressed. In any of the comparative samples Nos. 42 and 43 to which the component M was not added, the core loss was high.

TABLE 42

| No. | Classification | Contents of main elements (at. %) Fe | B | Si | C | M | Contents of other elements (mass %) Al | Ti | Core loss (W/kg) |
|---|---|---|---|---|---|---|---|---|---|
| 37 | Invention sample | 84.3 | 9.8 | 2.4 | 0.3 | As = 0.2 P = 2.8 | <0.005 | 0.11 | 0.119 |
| 38 | Invention sample | 83.5 | 10.2 | 2.4 | 0.6 | Bi = 0.8 P = 2.3 | 0.12 | <0.005 | 0.117 |
| 39 | Invention sample | 81.5 | 12.0 | 2.4 | 0.7 | Te = 0.1 P = 3.1 | 0.07 | 0.08 | 0.116 |
| 40 | Invention sample | 80.3 | 13.0 | 2.4 | 1.0 | Se = 0.2 P = 2.9 | 0.11 | 0.04 | 0.108 |
| 41 | Invention sample | 78.7 | 13.7 | 2.5 | 1.7 | P = 2.9 S = 0.3 | 0.09 | 0.08 | 0.109 |
| 42 | Comparative sample | 84.2 | 12.8 | 2.5 | 0.3 | <0.005 | 0.07 | 0.06 | 0.310 |
| 43 | Comparative sample | 78.9 | 15.1 | 2.5 | 3.3 | <0.005 | 0.09 | 0.10 | 0.230 |

Example 37

Mother alloys were produced by using a steel refined through an ordinary steelmaking process as the iron source. The iron source contained about 0.3 atomic % impurity elements such as Mn, Si, S and P in total. Ferroboron was used as the boron source, metallic silicon having the purity of 99.9 mass % as the silicon source, ferrophosphorus as the phosphorus source, and metallic carbon as the carbon source. These raw materials were blended into prescribed compositions, and then heated and melted in a high-frequency induction melting furnace. Thereafter, the molten metal was sucked up into a quartz tube 10 mm in diameter and bar-shaped mother alloys were produced. The chemical compositions of the mother alloys thus obtained are shown in Table 43. All the alloys contained about 0.2 atomic % impurity elements, such as Mn and S, in total.

Each of the mother alloys shown in Table 43 was then melted in a quartz crucible by high frequency induction heating. Then, thin strips were cast through the single-roll process by spraying the molten metal onto a cooling roll through a slot nozzle having a rectangular opening 0.4×25 mm in size and being fixed at the top of the crucible. The material of the cooling roll was Cu-0.5 mass % Be, the outer diameter thereof 580 mm, the surface speed 24.3 m/sec., and the gap between the nozzle and the roll surface 200 μm. The chemical compositions of the thin strips thus cast were substantially the same as those of the mother alloys shown in Table 43.

Test pieces were cut out from the center portions in the longitudinal direction of the thin strips thus obtained, and the test pieces were annealed at a temperature of 360° C. for 1 h. in a nitrogen atmosphere while a magnetic field of 50 oersted was applied. Then, the magnetic flux densities and the core losses of the test pieces were measured, and the embrittlement property was evaluated by bend tests.

The evaluation results are shown in Table 44. In the table, a magnetic flux density was the maximum magnetic flux density $B_{80}$ measured when a maximum impressed magnetic field was 80 A/m, a core loss was the value measured when a maximum magnetic flux density was 1.3 T and a frequency was 50 Hz, and the embrittlement property was the diameter of the bend at the time when a test piece fractured in a 180° bend test.

All the thin strips were cast successfully without serious problems, but the strip appearances were somewhat poor in the cases of the comparative samples Nos. 11 and 12.

In any of the invention samples Nos. 1 to 9, all the properties were good. However, in the comparative samples Nos. 10 to 16 having the chemical components outside the ranges specified in the present invention, there were cases where a good amorphous structure was not obtained and good results were not obtained in the magnetic and/or mechanical properties because of a low Fe content or the like.

TABLE 43

| Classification | No. | Alloying components (at. %) Fe | Si | B | C | P |
|---|---|---|---|---|---|---|
| Invention sample | 1 | 80.3 | 1.6 | 17.6 | 0.02 | 0.2 |
| | 2 | " | 2.5 | 13.7 | 0.1 | 3.2 |
| | 3 | " | " | 5.3 | " | 11.6 |
| | 4 | " | 4.4 | 12.1 | " | 2.9 |
| | 5 | 77.3 | 1.6 | 5.1 | 0.02 | 15.8 |
| | 6 | 77.2 | " | 18.8 | " | 2.1 |
| | 7 | 78.1 | " | 12.0 | 4.0 | 4.1 |
| | 8 | 83.2 | 2.1 | 12.5 | 0.2 | 1.8 |
| | 9 | 85.6 | " | 10.2 | 0.1 | " |
| Comparative sample | 10 | 80.3 | 2.5 | 16.2 | 0.8 | 0 |
| | 11 | " | 1.4 | 4.8 | 0.1 | 13.2 |
| | 12 | " | 4.7 | 10.1 | " | 4.6 |
| | 13 | 76.8 | 2.0 | 19.2 | 0.1 | 1.7 |
| | 14 | " | " | 4.7 | " | 16.2 |
| | 15 | 77.2 | " | 14.4 | 0 | 6.2 |
| | 16 | 86.3 | 1.6 | 6.7 | 4.2 | 1.0 |

TABLE 44

| Classification | No. | Thin strip properties B80 (T) | Core loss (W/kg) | Bend diameter (mm) |
|---|---|---|---|---|
| Invention sample | 1 | 1.52 | 0.078 | 1.8 |
| | 2 | 1.52 | 0.065 | 1.4 |
| | 3 | 1.48 | 0.088 | 2.2 |
| | 4 | 1.49 | 0.081 | 2.3 |
| | 5 | 1.43 | 0.102 | 2.5 |

TABLE 44-continued

| Classification | No. | Thin strip properties | | |
|---|---|---|---|---|
| | | B80 (T) | Core loss (W/kg) | Bend diameter (mm) |
| Comparative sample | 6 | 1.43 | 0.091 | 2.1 |
| | 7 | 1.45 | 0.081 | 1.5 |
| | 8 | 1.54 | 0.091 | 1.9 |
| | 9 | 1.51 | 0.108 | 2.6 |
| | 10 | 1.42 | 0.124 | 3.9 |
| | 11 | 1.41 | 0.134 | 3.6 |
| | 12 | 1.45 | 0.113 | 2.9 |
| | 13 | 1.36 | 0.098 | 3.2 |
| | 14 | 1.33 | 0.148 | 4.7 |
| | 15 | 1.39 | 0.129 | 3.5 |
| | 16 | 1.47 | 0.317 | 5.8 |

INDUSTRIAL APPLICABILITY the present invention makes it possible to provide: an iron-base amorphous alloy thin strip to be used as a material for the iron core of a power transformer, a high frequency transformer or the like, the amorphous alloy thin strip being excellent in overall soft magnetic properties not only in the amorphous mother phase, which properties are improved, of the thin strip, but also in an ultra-thin oxide layer formed on each of the surfaces of the strip, by actively adding P, which has hitherto been viewed as undesirable, and adequately controlling the addition amount of P; and an iron core manufactured by using said thin strip. In addition, the present invention makes it possible to provide a mother alloy for producing a rapidly cooled and solidified thin strip to be used for producing the above-mentioned iron-base amorphous alloy thin strip.

The invention claimed is:

1. An iron-base amorphous alloy thin strip characterized in that: the composition of said thin strip consists of the main elements of Fe, Si, B, C and one or more of P, As, Bi, S, Se and Te, and further containing one or more of Al, Ti, Zr, V and Nb that form precipitates combining with O, N or C; and the total content of the precipitate forming elements present in the composition of the thin strip is a maximum of 2.5 mass %.

2. An iron-base amorphous alloy thin strip according to claim 1, characterized in that the contents of said main elements are, in atomic percentage, in the ranges from 78 to 86% as to Fe, from 0.02 to less than 4% as to Si, from more than 5 to 16% as to B, from 0.02 to 8% as to C, and from 0.2 to 12% in total as to one or more of P, As, Bi, S, Se and Te.

3. An iron-base amorphous alloy thin strip according to claim 1, characterized in that: Al and/or Ti are contained in said thin strip as said precipitate forming elements; and the contents thereof are in the ranges from 0.01 to 1 mass % as to Al and from 0.01 to 1.5 mass % as to Ti.

4. An iron-base amorphous alloy thin strip according to claim 1, characterized in that the content of Al is in the range from 0.01 to 0.2 mass %.

5. An iron-base amorphous alloy thin strip according to claim 1, characterized in that the content of Ti is in the range from 0.01 to 0.4 mass %.

6. An iron-base amorphous alloy thin strip according to claim 2, characterized in that the total content of one or more of P, As, Bi, S, Se and Te is in the range from 1 to 12 atomic %.

* * * * *

UNITED STATES PATENT AND TRADEMARK OFFICE

CERTIFICATE OF CORRECTION

PATENT NO. : 7,282,103 B2
APPLICATION NO. : 10/479765
DATED : October 16, 2007
INVENTOR(S) : Hiroaki Sakamoto et al.

It is certified that error appears in the above-identified patent and that said Letters Patent is hereby corrected as shown below:

Column 16, line 19, change "$\Delta T_b$" to -- $\Delta T_B$ --;

Column 16, line 20, change "$\Delta T_{=TB}$max-$T_B$min" to -- $\Delta T=T_B$max-$T_B$min --;

Column 28, line 14, change "$\Delta T_b$" to -- $\Delta T_B$ --;

Column 29, line 47, change "$Fe_{8.0}Co_{0.2}$" to -- $Fe_{0.8}Co_{0.2}$ --;

Column 39, line 58, change "0.2" to -- 0.24 --;

Column 41, line 31, change "re" to -- were --;

Column 58, line 22, change "$\Delta T_{B\#}$60°c" to -- $\Delta T_B \geq$60°c --;

Column 63, line 37, change "ordinary" to -- Ordinary --;

Signed and Sealed this

Thirteenth Day of October, 2009

David J. Kappos

David J. Kappos
*Director of the United States Patent and Trademark Office*